US009669528B2

(12) United States Patent
Crawford et al.

(10) Patent No.: US 9,669,528 B2
(45) Date of Patent: Jun. 6, 2017

(54) ILLUMINATED PIPE WRENCH TOOL ASSEMBLY

(71) Applicant: ReadyMax, Inc., Elk Grove, CA (US)

(72) Inventors: Brent Crawford, Kentfield, CA (US); Bill Reimann, Zhuhai (CN); Bill E. Brauner, Angels Camp, CA (US)

(73) Assignee: ReadyMax, Inc., Elk Grove, CA (US)

( * ) Notice: Subject to any disclaimer, the term of this patent is extended or adjusted under 35 U.S.C. 154(b) by 0 days.

(21) Appl. No.: 14/670,299

(22) Filed: Mar. 26, 2015

(65) Prior Publication Data

US 2015/0196998 A1 Jul. 16, 2015

Related U.S. Application Data

(63) Continuation-in-part of application No. 14/201,249, filed on Mar. 7, 2014, now Pat. No. 9,157,629.

(Continued)

(51) Int. Cl.

| | |
|---|---|
| ***B25B 23/18*** | (2006.01) |
| ***F21L 4/02*** | (2006.01) |
| ***B25B 13/16*** | (2006.01) |
| ***F21V 33/00*** | (2006.01) |
| ***B25B 7/08*** | (2006.01) |

(Continued)

(52) U.S. Cl.

CPC ..... *B25B 23/18* (2013.01); *B25B 7/08* (2013.01); *B25B 7/10* (2013.01); *B25B 7/22* (2013.01); *B25B 13/16* (2013.01); *B25B 13/5058* (2013.01); *F21L 4/00* (2013.01); *F21V 33/0084* (2013.01)

(58) Field of Classification Search

CPC ..... B25B 23/18; B25B 13/16; B25B 13/5041

See application file for complete search history.

(56) References Cited

U.S. PATENT DOCUMENTS

| | | | | |
|---|---|---|---|---|
| 4,144,779 | A | 3/1979 | Honick | |
| 2007/0019400 | A1 * | 1/2007 | Clausen | B25G 1/102 362/109 |

FOREIGN PATENT DOCUMENTS

| | | |
|---|---|---|
| CN | 202137721 | 2/2012 |
| JP | 10-086072 | 7/1998 |

(Continued)

OTHER PUBLICATIONS

International Search Report for Application No. PCT/US2015/022984 dated Jun. 19, 2015.

(Continued)

*Primary Examiner* — Elmito Breval

(74) *Attorney, Agent, or Firm* — Beyer Law Group LLP

(57) ABSTRACT

A lighted pipe wrench assembly having a first wrench member and a second wrench member cooperatively joined. The first wrench member includes a head portion having a first jaw section and an interface section, and further includes an elongate neck portion having a longitudinal axis. A receiving channel extends laterally therethrough the interface section. A communication channel extends radially from the receiving channel to an end port which terminates at the work surface. A primary illumination device formed for removable, axial sliding receipt in the receiving channel of such that an output portion is aligned with the communication channel. A first end cap cooperate to securely abut and seat the illumination device therebetween, and secure to the coupling portion.

14 Claims, 22 Drawing Sheets

Related U.S. Application Data

(60) Provisional application No. 61/971,104, filed on Mar. 27, 2014, provisional application No. 61/871,083, filed on Aug. 28, 2013.

(51) Int. Cl.

| | |
|---|---|
| ***B25B 7/10*** | (2006.01) |
| ***B25B 7/22*** | (2006.01) |
| ***F21L 4/00*** | (2006.01) |
| ***B25B 13/50*** | (2006.01) |

(56) References Cited

FOREIGN PATENT DOCUMENTS

| | | |
|---|---|---|
| JP | 2003305661 | 10/2003 |
| KR | 10-1998-0022919 | 7/1998 |

OTHER PUBLICATIONS

Written Opinion for Application No. PCT/US2015/022984 dated Jun. 19, 2015.

* cited by examiner

ILLUMINATED PIPE WRENCH TOOL ASSEMBLY

CROSS REFERENCE TO RELATED APPLICATIONS

This application claims priority under 35 U.S.C. §119(e) from U.S. Provisional Patent Application No. 61/971,104, filed Mar. 27, 2014, entitled "ILLUMINATED PIPE WRENCH TOOL ASSEMBLY", naming Crawford et al. as inventors, and further is a continuation-in-part application based upon patent application Ser. No. 14/201,249, filed Mar. 7, 2014, and entitled "ILLUMINATED HAND TOOL ASSEMBLY", naming Brauner et al. as inventors, and which in turn claims priority under 35 U.S.C. §119(e) from U.S. Provisional Patent Application No. 61/871,083, naming Brauner et al as inventors, filed Aug. 28, 2013, and entitled ILLUMINATED PLIERS ASSEMBLY, and all of which are incorporated herein by reference in their entirety and for all purposes.

FIELD OF THE INVENTION

The present invention relates to hand operated tools, and more particularly, relates to illuminated hand tool assemblies

BACKGROUND OF THE INVENTION

Poorly lit work environments will always pose additional risks to any personnel operating hand tools. This problem is particularly troublesome for industrial application where equipment that is located next to other components that can easily be damaged or that present a hazard to the technician, such as exposed high-voltage sources or heavy equipment.

While external lighting is an obvious solution, it may not always be practical due to space and power source limitations where such tools are to be applied. For example, the external light may require it to be connected to an outlet by an extension cord and that the technician hangs in a position to illuminate the component. Such outlets, of course, are not always located near the equipment that is to be serviced. Furthermore, the light may relatively large so that technicians may not normally carry them when inspecting and adjusting equipment.

Several hand tools have been developed that contain their own light source, instead of depending upon the need for external lighting. The advantage of this approach is that the beam of light contained in the tool generally can be directed at the work area where the technician is performing the work without any additional manipulation and maneuvering of the light source.

One significant problem with most of these lighted hand tool approaches is that either the light generated by the tool is of lower intensity and insufficient, or the addition of the light impair the use of the tool. Accordingly, there is a need for improved lighted hand tool, such as a lighted pliers hand tool, that has a high intensity light source with a low power consumption that will provide illumination directly to the desired work area or object to be grasped by the pliers hand tool.

SUMMARY OF INVENTION

The present invention provides a lighted pipe wrench assembly comprising a first wrench member and a second wrench member cooperatively joined. The first wrench member includes a head portion having a first jaw section and an interface section, and further includes an elongate neck portion having a longitudinal axis. The neck portion integrally intersects a work surface of the first jaw section at the interface section, generally at a right-angle therebetween. The interface section further defines a receiving channel extending laterally therethrough from one side of the interface section to an opposite side thereof. The interface section further defines a communication channel that extends radially from the receiving channel to an end port. The end port terminates at the work surface, and provides light communication between the work surface and the communication channel. The second wrench member includes a second jaw portion, a handle portion and a coupling portion integral between the second jaw portion and the second handle portion. The coupling portion further cooperates with the elongate neck portion of the first wrench member to orient the first and second jaw portions are in aligned and opposed relationship to one another, collectively defining a work area, and to movably couple the first wrench member to the second member for selective movement in a direction substantially along the longitudinal axis of the neck portion to selectively adjust the size of the work area.

An illumination device is provided having an illumination output portion outputting a direct light beam therefrom. The illumination device further includes a housing that is formed and dimensioned for removable, axial sliding receipt in the receiving channel of the interface section such that the output portion is aligned with the communication channel. A first end cap is disposed in a first opening into the receiving channel, and a second end cap is disposed in an opposite second opening into the receiving channel. The first end cap and the second end cap cooperate to securely abut and seat the illumination device therebetween.

In one specific embodiment, the output portion of the illumination device includes an alignment key portion that extends radially outward from the exterior surface of the housing, and is generally perpendicular to a longitudinal axis of the illumination device. The alignment key being is formed and dimensioned for sliding receipt in a portion of the communication channel.

Another configuration provides a communication channel that tapers outwardly from the receiving channel to the end port.

In still another specific embodiment, the illumination device includes a button assembly on one end of the housing, and the first end cap includes a cover disk portion defining a button port formed for receipt of at least a portion of the button assembly to enable operable access thereof when mounted in the first opening of the receiving channel.

Yet another specific configuration provides an illumination device that includes a battery cover on an opposite end of the housing. The second end cap includes a cover disk portion defining a battery cover port formed for operable access to the battery cover when mounted the second opening of the receiving channel.

In one embodiment, an interior wall defining the receiving channel is threaded. Further, the first end cap and the second end cap are threadably mounted to the interior wall. Each the first end cap and the second end cap include respective annular contact walls downwardly depending from an underside of the respective cover disk portion thereof. Each respective contact wall having an exterior surface configured for threaded engagement with the threaded interior wall of the receiving channel Each respective contact wall having an interior facing surface defining a respective receiving recess formed and dimensioned for respective seated receipt of the one end and the opposite end the housing when both the first end cap and the second end cap are threadably mounted to threaded interior wall.

In another specific embodiment of the present invention, the coupling portion of the second wrench member houses a secondary light device that provides illumination in a direction forward of the handle portion. The coupling portion includes a first side, an opposite second side, and a front wall extending therebetween. The coupling portion further defines a receiving passage extending laterally therethrough from the first side to the second side thereof. A communication aperture extends radially from the receiving passage to an end opening terminating at the front wall surface for light communication therebetween.

A secondary light device is provided that includes a light output portion outputting a direct light beam therefrom. This light device includes housing formed and dimensioned for removable, axial sliding receipt in the receiving passage of the coupling portion of the second wrench member such that the output portion is aligned with the communication passage. Similar to the primary illumination device, which illuminate the work area, a first end cover is disposed in a first opening into the receiving passage, and a second end cover is disposed in an opposite second opening into the receiving passage. The first end cover and the second end cover cooperate to securely abut and seat the light device therebetween.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DETAILED DESCRIPTION OF THE INVENTION

Figure 1:
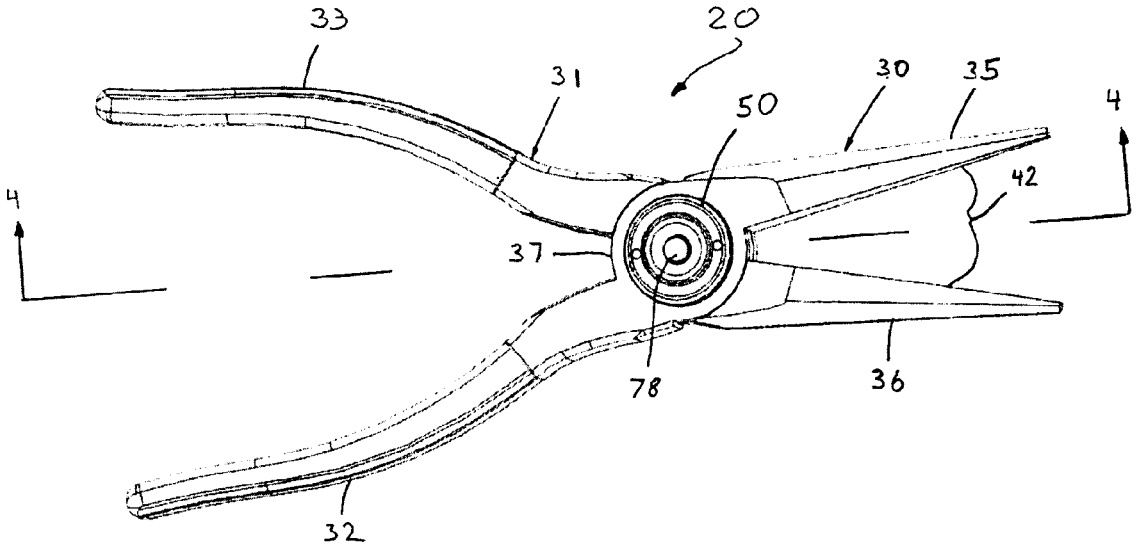
FIG. 1 is a side perspective view of a lighted hand tool apparatus constructed in accordance with the present invention, illustrated in an opened condition.
Figure 2:
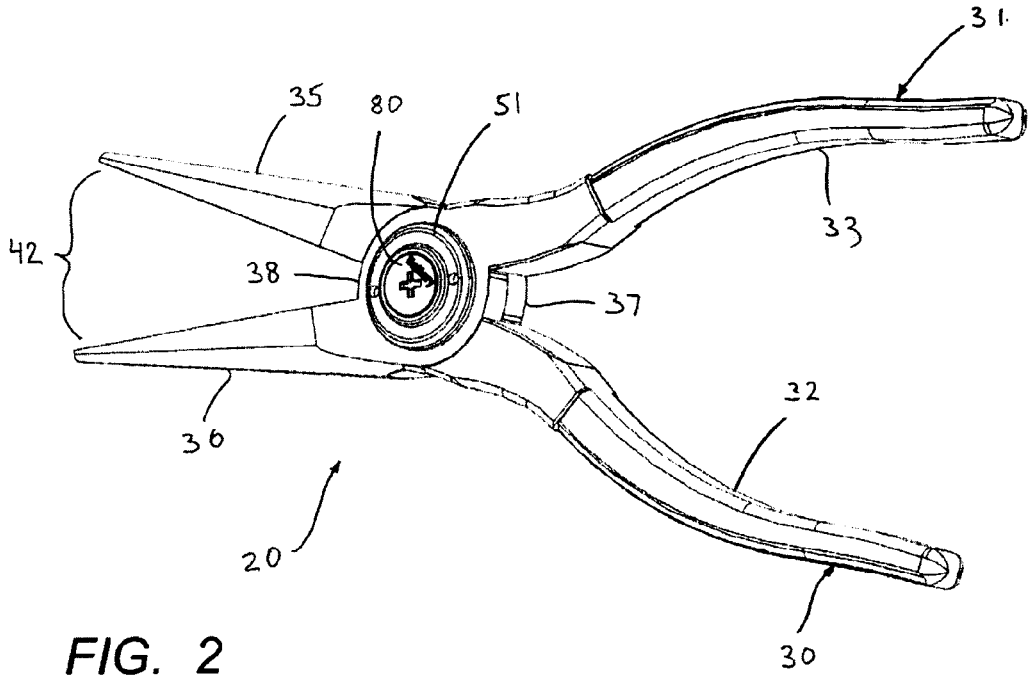
FIG. 2 is an opposite side perspective view of the lighted hand tool apparatus of FIG. 1.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Referring now to FIGS. 1-7, 12 and 13, a lighted hand operated tool apparatus, generally designated 20, is shown including a generally cylindrical-shaped rivet member 21 having an exterior wall 22 and a threaded interior wall 23 defining a receiving channel 25. This channel extends longitudinally from a first opening 26 at one end of the rivet member 21 to a second opening 27 at an opposite end thereof. The rivet member 21 additionally defines a side communication port 28 radially extending into the receiving channel 25 from the exterior wall 22 to the threaded interior wall 23 thereof. The hand tool apparatus further includes a first tool member, generally designated 30, and a second tool member, generally designated 31. Each hand tool member 30, 31 includes a respective handle portion 32, 33, a jaw portion 35, 36, and an intermediate pivot portion 37, 38, therebetween. Each respective pivot portion 37, 38 further defines a respective generally cylindrical bore section 40, 41 extending substantially laterally across the corresponding pivot portion 37, 38. The bore sections 40, 41, are further configured for co-axially aligned receipt of the rivet member 21 therein. In a secured condition, the rivet member 21 prevents lateral separation of the first and second tool members 30, 31 from one another, while simultaneously interconnects them together for relative pivotally movement of the respective jaw portions 35, 36. This movement collectively defines a work area 42 as the jaw portions move between an opened condition (FIG. 3, although nearly every figure) and a closed condition. When the rivet member 21 is in the secured condition, the rivet member communication port 28 is in communicative alignment with a respective central passageway 43, 45 defined by at least one of the respective pivot portions 37, 38. These passageways 43, 45 extend from the respective bore section 40, 41 to an end port 46 which terminates at the work area to permit communication of the rivet member receiving channel 25 with the work area 42 during operative use.

The hand tool apparatus further includes an illumination device 47 (FIGS. 4, 5, 14 and 15) having an illumination output portion 48 outputting a direct light beam therefrom. The illumination device includes a housing 49 formed and dimensioned for removable, axial sliding receipt in the receiving channel 25 of the rivet member 21 in a manner aligning the output portion 48 with the side communication port 28 to directly illuminate the work area 42 during operative use. A first end cap 50 (FIGS. 1, 3, 5 and 19-21) is included that is threadably disposed in the first opening 26 of the rivet member 21 while an opposed second end cap 51 (FIGS. 2, 5 and 22-24) is threadably disposed in the second opening 27 of the rivet member 21. The first end cap 50 and the second end cap 51 cooperate to securely abut and seat the illumination device 47 therebetween.

Accordingly, a handheld hand tool assembly is provided having a light assembly housed in the pivot portion between the two hand operational tool members, similar to our previous design, U.S. Pat. No. 7,399,101, herein incorporated by reference in its entirety. Unlike previous designs, however, complete assembly of the end caps and illumination device with the hand tool members is not necessary to prevent lateral separation therebetween. In other words, in these prior designs, disassembly of the hub device, which housed the illumination devices, would also cause disassembly of the hand tool members.

In accordance with the present invention, the hollow rivet member 21 not only houses and seats the illumination device 47, but also functions to retain the first and second tool members 30, 31 laterally together. Moreover, this rivet member also provides pivotal support to the hand tool members, enabling pivotal operation about the hand tool assembly's rotational axis 55

Figure 6:
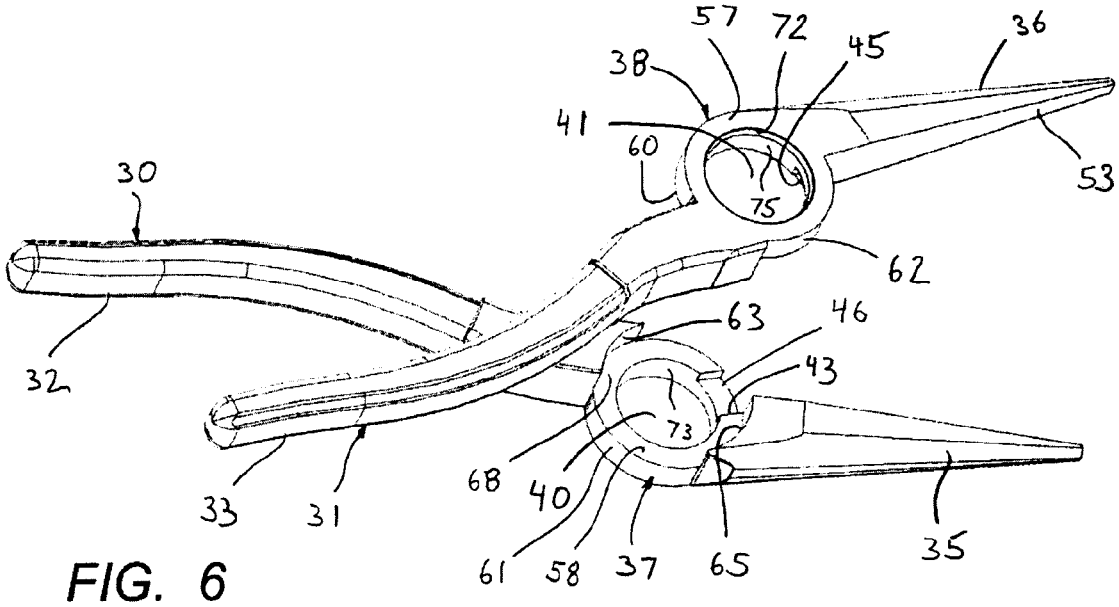
FIG. 6 is an exploded, rear perspective view of a first tool member and second tool member of the lighted hand tool apparatus of FIG. 1, prior to interengagement at their respective pivot portions.
Figure 7:
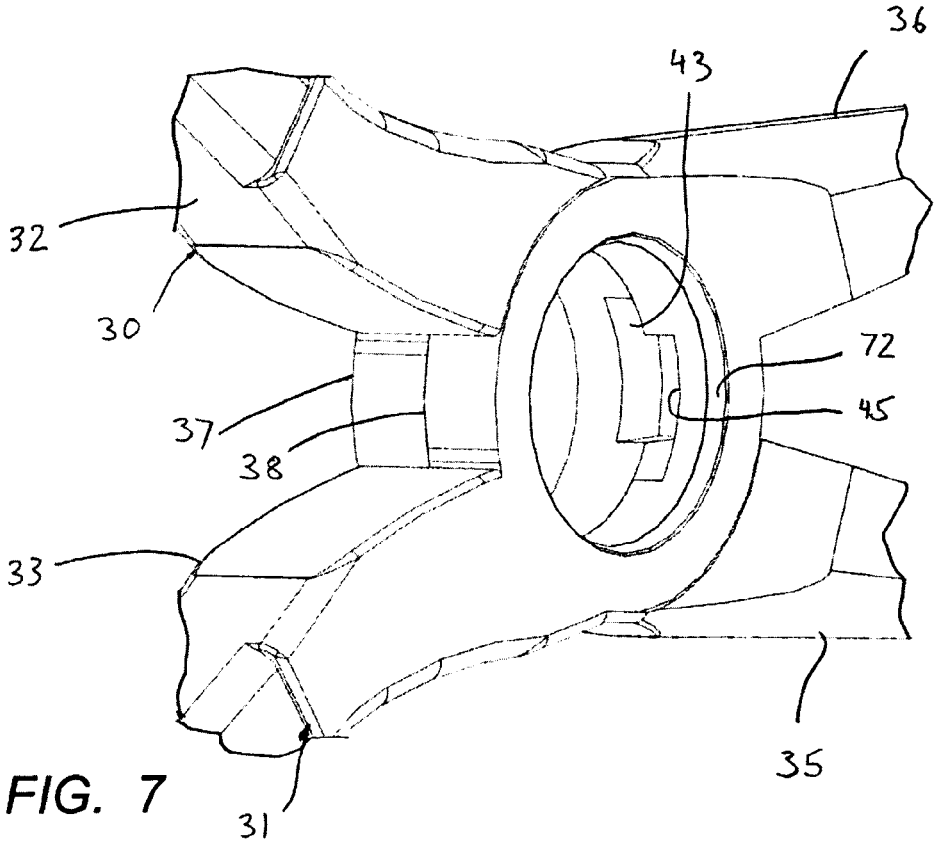
FIG. 7 is an enlarged, fragmentary, rear perspective view of the first and second tool members of FIG. 6, after interengagement their respective pivot portions.

FIGS. 6 and 7 best show that the first tool member 30 and the second tool member 31 are generally identical to another but are flipped around 180 Deg, relative to one another during assembly, and are interengaged at their respective pivot portions 37, 38 to co-axially align their respective bore sections 40, 41, in a cross-jaw formation. Similar to most "cross-jaw" hand tool designs, by squeezing the respective handle portions 32, 33 together, the gripping force of the opposed jaw portions 35, 36 can be controlled from the opened condition (FIGS. 1-3 and 7) toward the closed condition.

Each hand tool member 30, 31 is preferably comprised of a metallic material, for strength purposes, and is more preferably comprised of stainless steel. It will be appreciated, however, that the hand tools may be composed of other lightweight, synthetic or exotic materials.

As previously mentioned, each respective jaw portion 35, 36 includes an opposed work surface 52, 53 that collectively define the work area 42 when the hand tool members 30, 31 are operationally interconnected about the rivet member 21. While the shape and area of the work surfaces 52, 53 are shown as being relatively trapezoidal and substantially planar, these dimensions may be varied, and the work surfaces may be conventionally teethed, kneeled or ridged to promote frictional gripping.

Further, the footprint of each jaw portion 35, 36 is shown in a "needle-nose" pliers shape, where the jaw portions taper inwardly from the proximal end to the distal end thereof. This tapered shape is particularly useful for certain applications such as for fishing. Other conventional pliers jaw shapes can be implemented as well, however, depending upon the desired application, without departing from the true spirit and nature of the present invention. In fact, it will be appreciated that this embodiment of the present invention applies to any "cross-jaw" hand tool designs, such as slip joint pliers, lineman's pliers, round-nose pliers, flat-nose pliers, crimping pliers, circlip pliers, diagonal pliers, nippers, cutters and pincers, etc.

Figure 3:
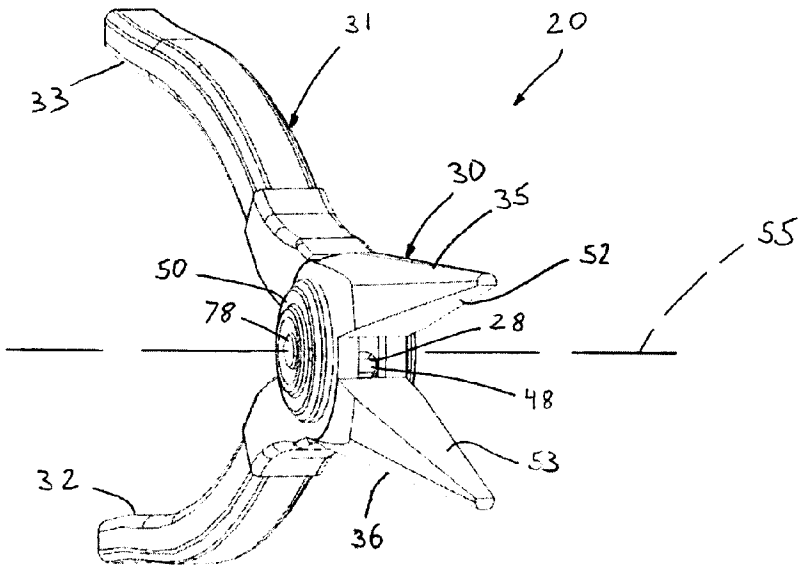
FIG. 3 is a front perspective view of the lighted hand tool apparatus of FIG. 1
Figure 4:
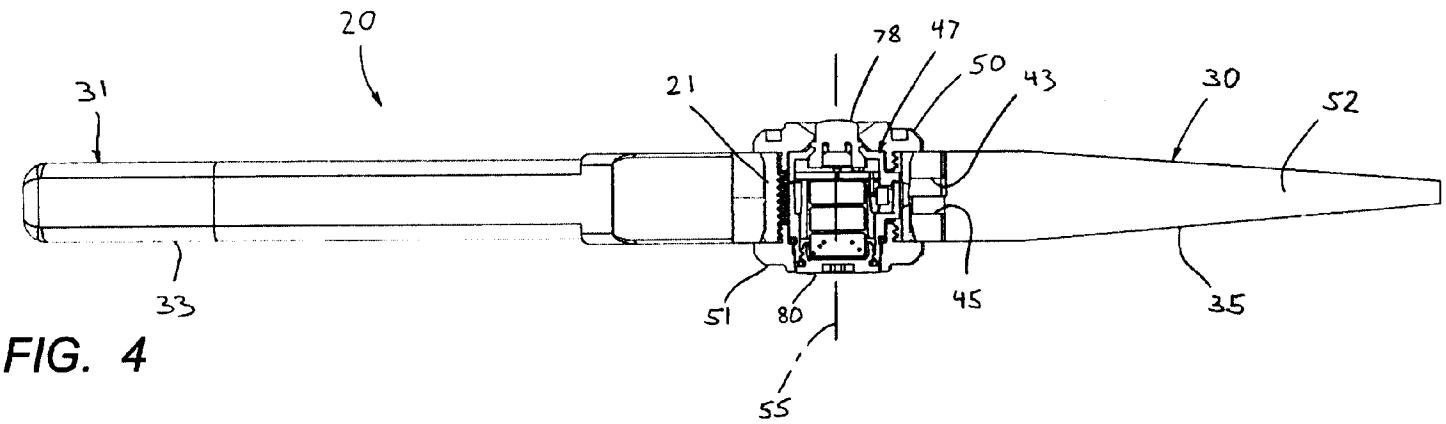
FIG. 4 is a bottom plan view, in cross-section, of the lighted hand tool apparatus taken along the plane of the line 4-4 in FIG. 1.
Figure 11:
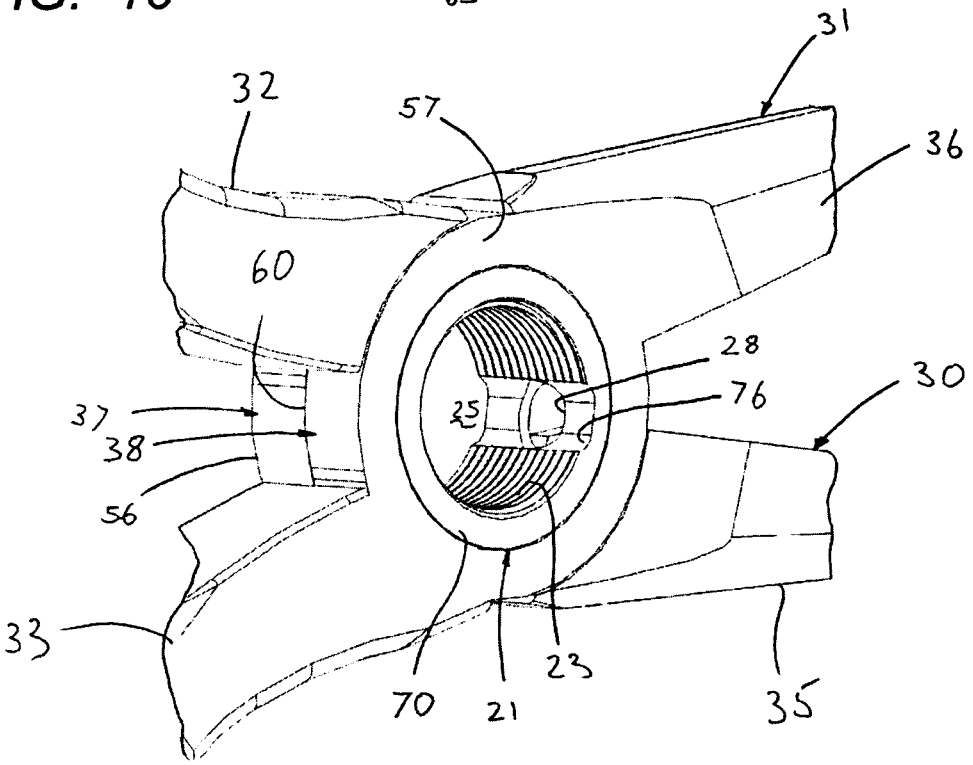
FIG. 11 is a fragmentary, rear perspective view of the first and second tool member of FIG. 7 with the rivet member installed.

With respect to the handle portions 32, 33, each is curved along a path generally opposite to one another when the hand tool members 30, 31 are operationally interconnected at the pivot portions 37, 38 via the rivet member 21 (i.e., FIGS. 3 and 11). Such curvatures, however, can be altered for a desired application, or the handle portions may be relatively linear. Moreover, the handle portions 32, 33 may be knurled or textured to enhance gripping, or may include plastic or rubber sleeves and grips, also to promote gripping and comfort.

Figure 8:
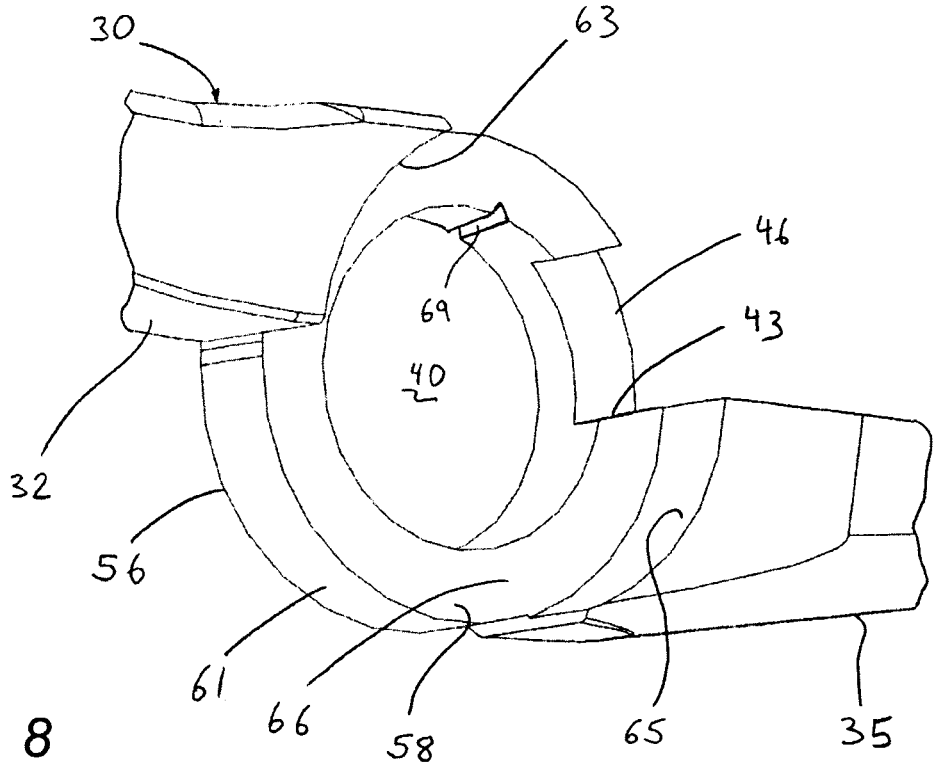
FIG. 8 is a fragmentary, rear perspective view of only the first tool member of FIG. 6.

Coupling the respective handle portion 32, 33 to the respective jaw portion 35, 36 in each the first and second tool member 30, 31, is the respective pivot portion 37, 38. Briefly, each respective pivot portion 37, 38 is generally disk-shaped and defines the respective bore section 40, 41 extending laterally therethrough from a respective outer facing wall 56, 57 to a respective inner facing wall 58, 60 thereof. Each bore section is also generally cylindrical shaped, and generally concentric to each corresponding pivot portion, forming respective pivot rings 61, 62. This is best shown in FIG. 8, which illustrates only first tool member 30 itself for descriptive purposes. Here it can be seen that one circumferential portion of the pivot ring 61 is integrally formed with a distal portion of the respective first handle portion 32 while opposite circumferential portion is integrally formed with a proximal portion of the first hand tool jaw portion 35.

The width of the respective pivot ring 61 is narrower than that of the adjoining distal portion of the handle portion 32, and of the adjoining proximal portion of the respective jaw portion 35. Accordingly, portions of the distal end wall 63 of the respective first handle portion 32, and of the proximal end wall 65 of the first tool jaw portion 35 cooperate to define a partial receiving socket 66, formed and dimensioned for rotational receipt of the opposed pivot ring 62 of the second tool member 31. Similarly, the corresponding partial receiving socket 66 of the pivot portion 38 of the second tool member 31 is formed and dimensioned for rotational receipt of the opposed pivot ring 61 of the first tool member 30 (FIGS. 6-8).

In general, the corresponding pivot rings 61, 62 are off-set to the outside of the pivot portion, opposite that of the respective receiving sockets 66, 67. Moreover, the width of the pivot ring 61 is about one-half the width of the distal end wall 63 of the respective first handle portion 32, and of the proximal end wall 65 of the first tool jaw portion 35. Accordingly, when the first and second tool members 30, 31 are flipped over 180 Deg, relative to one another, and are assembled such that the respective pivot rings 61, 62 are received in the opposing receiving sockets 66, 67, co-axially aligning the respective bore sections (FIGS. 6 and 7), it will be appreciated that the collective width of the pivot rings 61, 62 is similar to, and integral with, the corresponding ends of the opposed jaw portions 35, 36 and handle portions 32, 33.

FIGS. 6 and 11 further illustrate that at least one of the pivot portions 37, 38 includes a respective central passageway 43, 45 extending from the respective bore section 40, 41 to an end port 46 terminating at the work area 42. These passageways 43, 45 enable light communication (i.e., from the illumination device 47) from the receiving channel 25 of the rivet member 21 to the work area during operable use of the first and second tool members 30, 31. Preferably each respective pivot portion 37, 38 defines its own generally rectangular prism-shaped central passageway 43, 45. These two opposed passageways 43, 45 cooperate to enable light transmission from the mounted illumination device 47 to the work area.

In accordance with the present invention, in the secured condition, the rivet member 21 laterally retains the pivoting first and second tool members together regardless of whether or not the illumination device, and/or end caps are secured to the hand tool apparatus 20 (FIGS. 5 and 9-11). That is, once the rivet member is oriented in the secured condition, as will be described in greater detail, the hand tool members 30, 31 will no longer be capable of axial separation from one another along the rotational axis 55.

However, the rivet member 21 must enable relative rotation of at least one of the hand tool members 30, 31 about the common rotational axis 55, lest the hand tool members could not rotate relative to one another. On the other hand, allowing the tubular rivet member 21 to freely rotate about the rotational axis 55 would be disadvantageous since the output portion 48 of illumination device 47 would then also rotate freely about the rotational axis. Consequently, the output portion 48 could then be easily misaligned with the pivot portion central passageways 43, 45.

Accordingly, the rivet member 21 is fixedly mounted in the bore section 40, 41 of either the first tool member 30 or the second tool member 31, preventing relative rotation with at least one hand tool member thereof. Such fixation can be performed using any conventional technique including adhesives, lock screws, keys, etc., Other techniques include press-fit mounting, ribbing of one or both opposed surfaces, and/or heat treatment and pressure.

Figure 9:
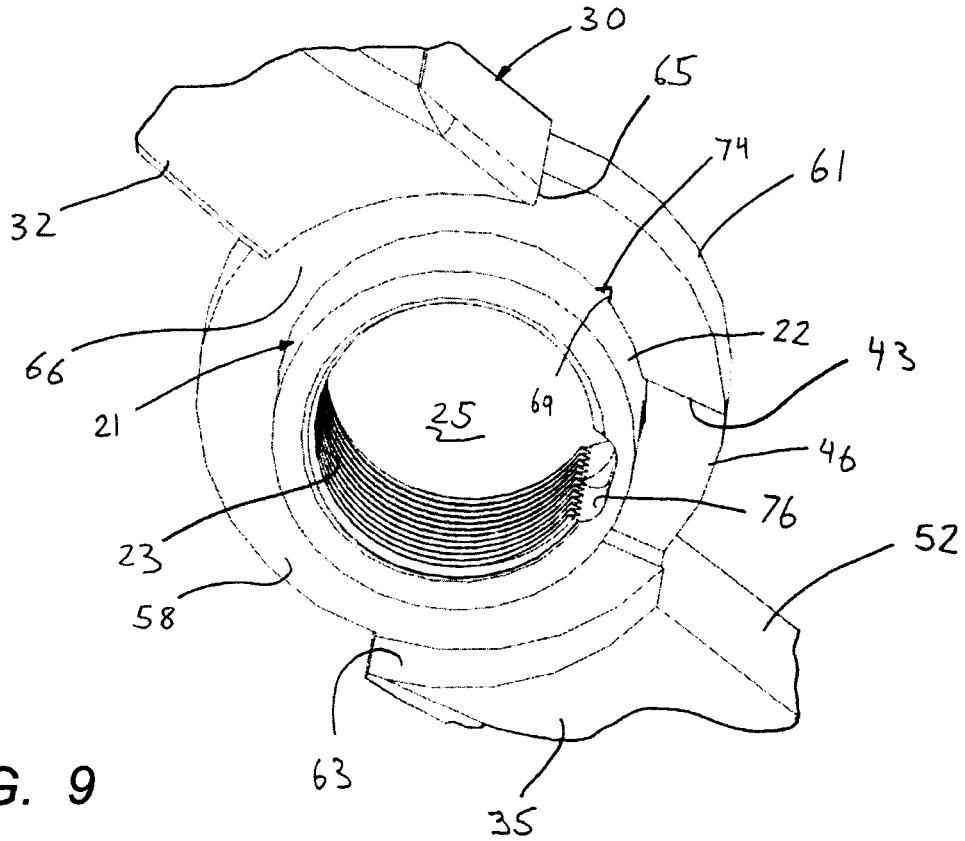
FIG. 9 is a fragmentary, rear perspective view of the first tool member of FIG. 6 with a rivet member installed.
Figure 10:
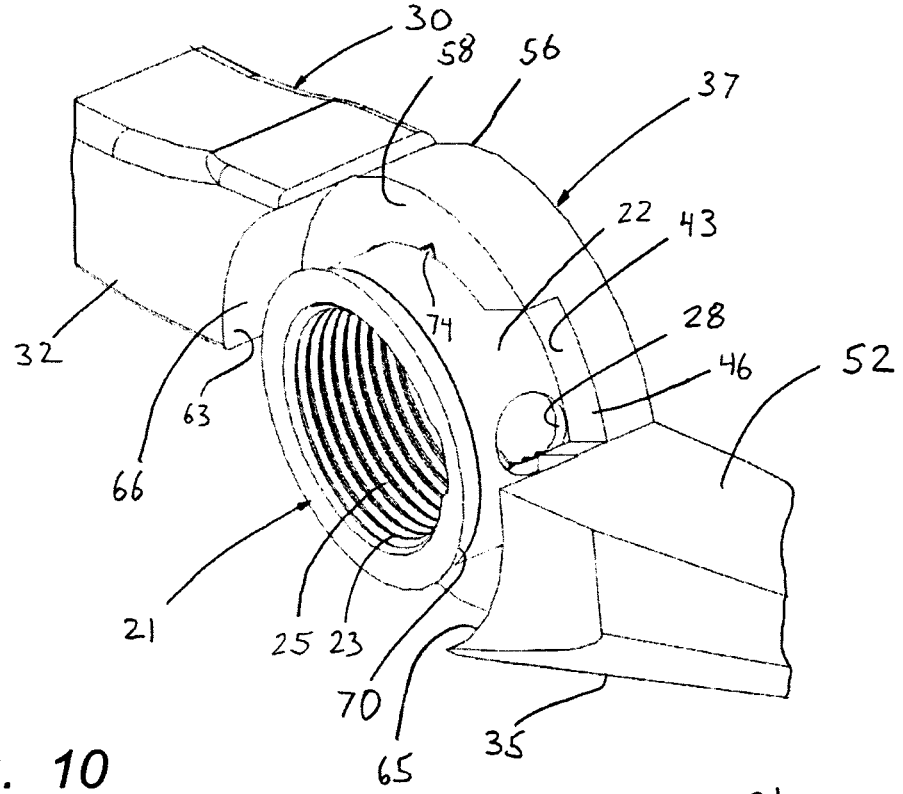
FIG. 10 is a fragmentary, front perspective view of the first tool member of FIG. 9, but illustrating one end of the rivet member with a swaged, annular retaining lip.

In one particular example, as shown in FIGS. 8-10, the interior wall 73 that defines bore section 40 may include a channel or notch 69 that extends in laterally thereacross. When the rivet member 21 is slideably and snugly received in the bore section 40, and the rivet member is press-forged or swaged, as will be described in greater detail below, retaining the hand tool members 30, 31 together, the exterior wall 22 can be sufficiently flow into the notch 69. A rib 74 is formed, that will prevent the rotation of rivet 21 within the bore section 40.

In another example, press-fit or interference-fit mounting of the rivet member 21 into one of the bore sections 40, 41 of the either the first tool member 30 or the second tool member 31 could be accomplished by forcing the rivet member 21 into a slightly undersized bore section. That is, by simply adjusting the diameter of the bore section 40, 41 that is forged and/or milled into the respective corresponding pivot portion 37, 38, the hand tool member 30 can be configured to either be affixed to the hand tool member or rotate relative to the same. A slightly smaller diameter of the bore section than that of the exterior wall 22 of the rivet member 21, for instance, for a press-fit mount, or conversely, a slightly larger bore diameter than that of the rivet member 21 for a rotating mount.

Figure 12:
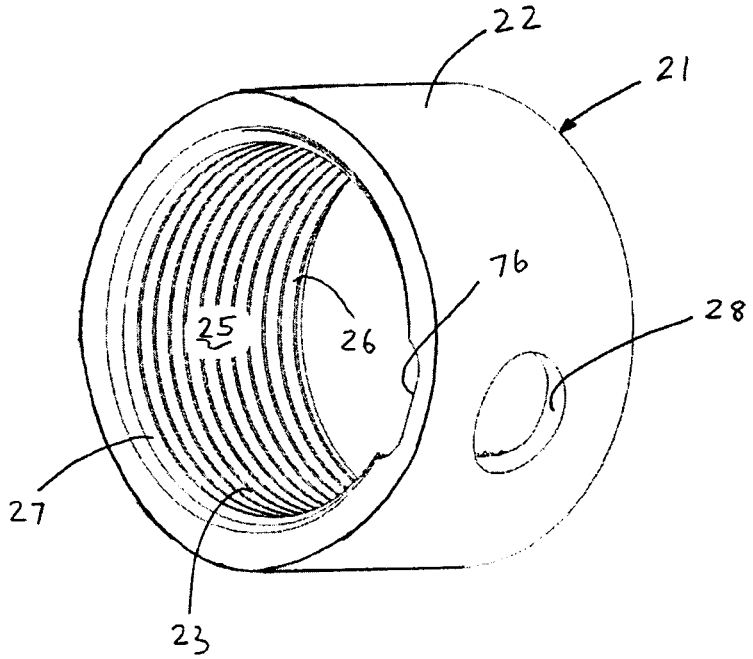
FIG. 12 is an enlarged, side perspective view of the rivet member of the lighted hand tool apparatus of FIG. 1.

FIGS. 9 and 12 best illustrates that the rivet member 21 is initially a cylindrical, tubular structure composed of a metallic material. Similar to the hand tool member components, the rivet member is more preferably composed of stainless steel.

Both the exterior wall 22 and the interior wall 23 are initially relatively smooth. As mentioned, the bore diameter of the bore section 40 of the first tool member 30 is slightly smaller than that of the rivet member outer diameter, creating a press-fit or interference fit engagement therebetween. For example, the outer diameter of the rivet member 21 may be in the range of about 19.0 mm to about 20.0 mm, while that of the bore section 40 of the first tool member may be in the range of about 15.5 mm to about 16.5 mm. In contrast, the diameter of the bore section 41 of the second tool member 31 may be in the range of about 19.5 mm to about 20.5 mm, enabling relative rotation therebetween albeit still providing a snug fit.

Prior to affixation of the rivet member 21 to the first tool member 30, for example, the side communication port 28 of the rivet member is rotationally aligned with the central passageway 43. With respect to the central passageway 43 of the first tool member 30, the transverse cross-sectional dimension of the central passageway 43 really only needs to be similar to that of the side communication port 28 due to the affixation in the corresponding bore section 40. As above indicated, however, the first and second tool members 30, 31 are identical to one another so as not to require the fabrication of two distinctive parts. Accordingly, at least the height dimension of the transverse cross-sectional area of the central passageways 43, 45 is much taller than that of the side communication port 28. This is necessary to provide a continuous light path therethrough for the illumination device output portion as the opposed tool member (e.g., the second tool member 31) articulates between the closed and opened conditions.

With respect to the smaller cross-sectional dimension of the side communication port 28, thus, proper alignment relative to the central passageway 43 of the first tool member, for instance, is required. Briefly, the preferred alignment orients the side communication port 28 generally in the direction of the corresponding work surface 52 of the first tool jaw portion 35 (FIGS. 9-11). When the illumination device is mounted to the rivet member 21, the light beam for the output portion 48 will always be at least partially directed on the work surface 52. This assures continuous lighting on at least one of the work surfaces of the corresponding jaw member even when the tool apparatus is nearly in the closed position.

Figure 13:
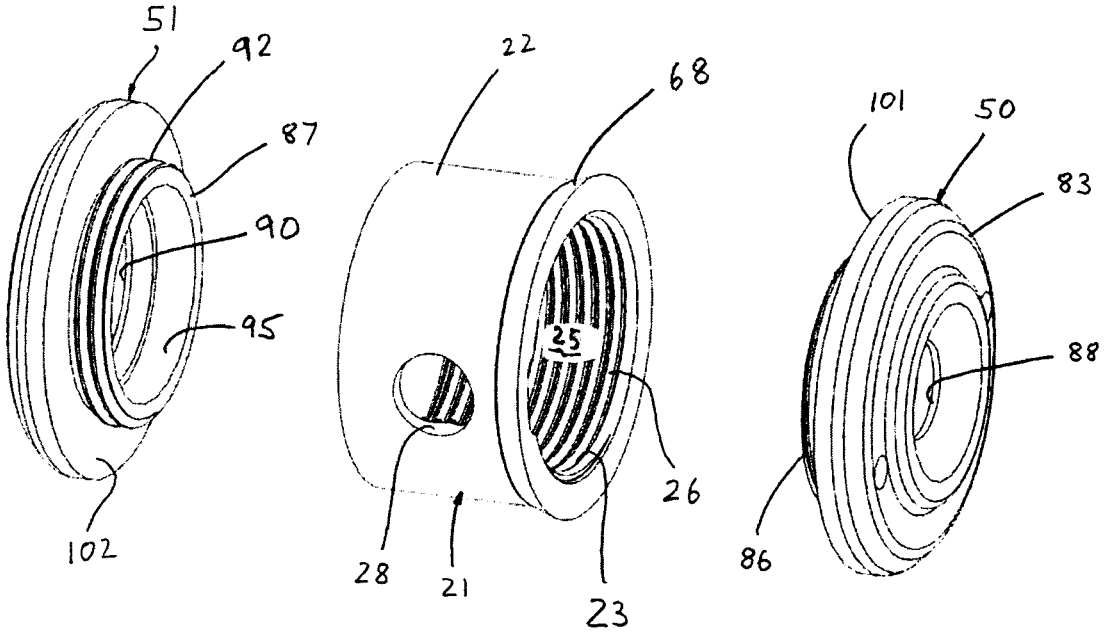
FIG. 13 is an enlarged, exploded, side perspective view of the rivet member and a first end cap and a second end cap of the lighted hand tool apparatus of FIG. 1.

To initially assemble the tool members, the rivet member 21 is axially pressed into the corresponding bore section 40 of the first tool member 30 using conventional interference-fit techniques (FIGS. 10 and 11). Briefly, it will be appreciated that FIGS. 10 and 13 show one end of the rivet member 21 with a swaged end, forming a flared retaining lip 68, for illustration purposes which incidentally is not swaged until assembly of the two hand tool members. This will be described in greater detail below.

Returning back to the assembly of the hand tool members, the second tool member 31 is properly oriented such that the hand tool jaw portions 35, 36 are opposed to one another (FIGS. 6 and 7), and that the respective pivot rings 61, 62 are simultaneously received in the opposed receiving sockets 66, 67, axially sliding the rivet member 21 into the second tool bore section 41. In this orientation, as best shown in FIGS. 7 and 11, the respective bore sections 40, 41 of the first and second tool members 30, 31 are oriented adjacent one another and co-axially aligned.

In accordance with the present invention, to axially retain the first and second tool members 30, 31 together, the opposed annular end edges of the rivet member 21 are swaged, flaring these end edges outwardly and radially past the opposed ends of the respective bore sections. This forms the opposed annular retaining lips 68, 70 (FIGS. 5 and 11), in the secured condition, that greater in diameter than that of the respective bore sections, preventing lateral separation of the first and second tool members 30, 31 from one another.

To facilitate the swaging process, the distal edges of the opposed ends of the rivet member are dimensioned to extend slightly just past the opposed outer facing walls 56, 57 of the corresponding pivot portions 37, 38 (not shown). This allows the opposed ends to be swaged radially outward, as well as be swaged flush with the opposed outer facing walls 56, 57. By way of example, the outer edges of the rivet member extend past the opposed outer facing walls by a distance of about 0.5 mm to about 2.0 mm.

Figure 5:
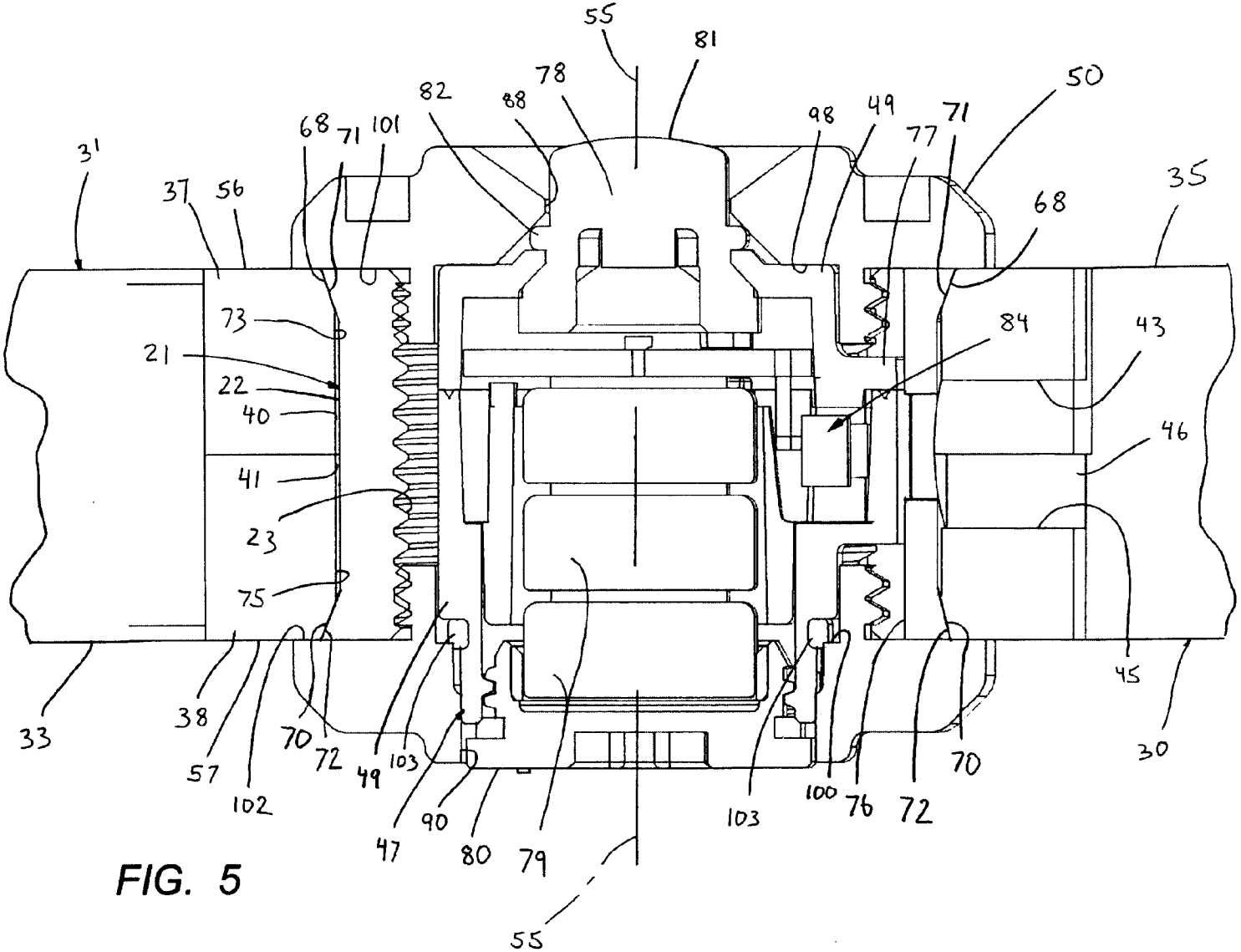
FIG. 5 is an enlarged, fragmentary, bottom plan view of the intermediate pivot portion and illumination assembly of the lighted hand tool apparatus of FIG. 4.

As best shown in FIGS. 5, 10 and 13, to accommodate the swaged retaining lips 68, 70, respective annular retaining chamfers 71, 72 are provided in each pivot portion 37, 38. These chamfers are located proximal to the respective outer portions of the bore sections 40, 41, where the interior walls 73, 75 taper radially outward until they intersect the respective outer facing wall 56, 57 of the pivot rings 61, 62.

Accordingly, when the distal edges of the rivet member 21 are swaged, these edges are pushed radially outward, and deformed into the respective retaining chamfer 71, 72, forming retaining lips 68, 70. These annular chamfers 71, 72, thus, provide an avenue for the retaining lips 68, 70 to expand into during the swaging procedure.

By way of example, each chamfer tapers outwardly at an angle in the range of about 10 Deg to about 20 Deg., and has an axial length of about 1.5 mm. These annular chamfers 71, 72 facilitate retainment of the first and second tool members 30, 31 laterally together, by permitting the outer edges of the rivet member to be swaged outward using convention swaging techniques.

Once the rivet member 21 is secured in the respective bore sections 40, 41 of the pivot portions 37, 38, machined and polished, etc., an alignment slot 76 is cut or milled into the initially unthreaded interior wall 23 of the rivet member (FIGS. 9, 11, 12 and 16). This alignment slot 76 is preferably generally linear, and extends longitudinally along the interior wall 23 in the direction of the rotational axis 55. This alignment slot 76 is formed and dimensioned for sliding axial receipt of an alignment key portion 77 the illumination device housing 49. In turn, this prevents rotation of the illumination device 47 therein. Moreover, the orientation of the alignment slot 76 corresponds with the alignment with the side communication port 28, aligning the illumination device output portion 48 with the rivet communication port and first tool central passageway 43.

Subsequently, the unthreaded interior wall 23 can be tapped, forming the final threaded interior wall 23. This is best exemplified in FIG. 12.

Figure 14:
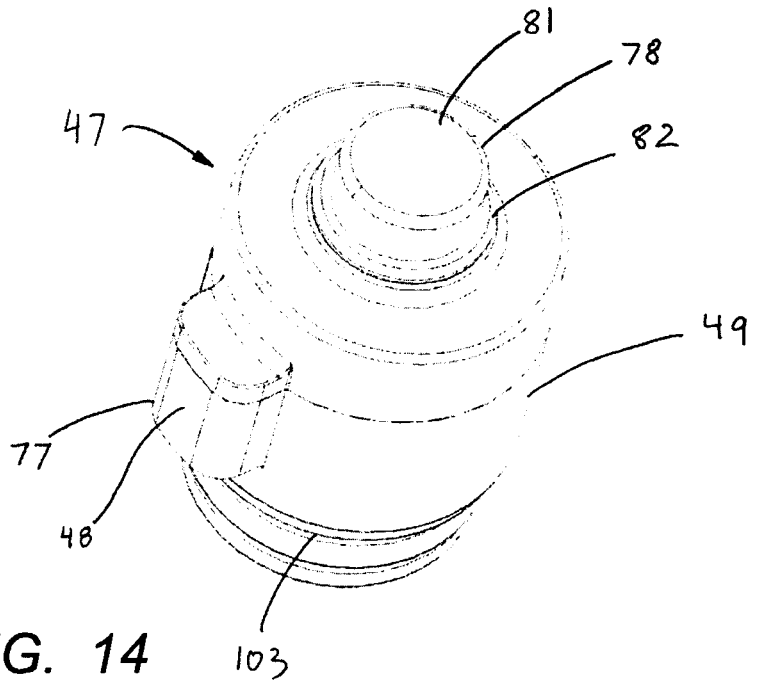
FIG. 14 is an enlarged, top perspective view of an illumination device of the lighted hand tool apparatus of FIG. 1.
Figure 15:
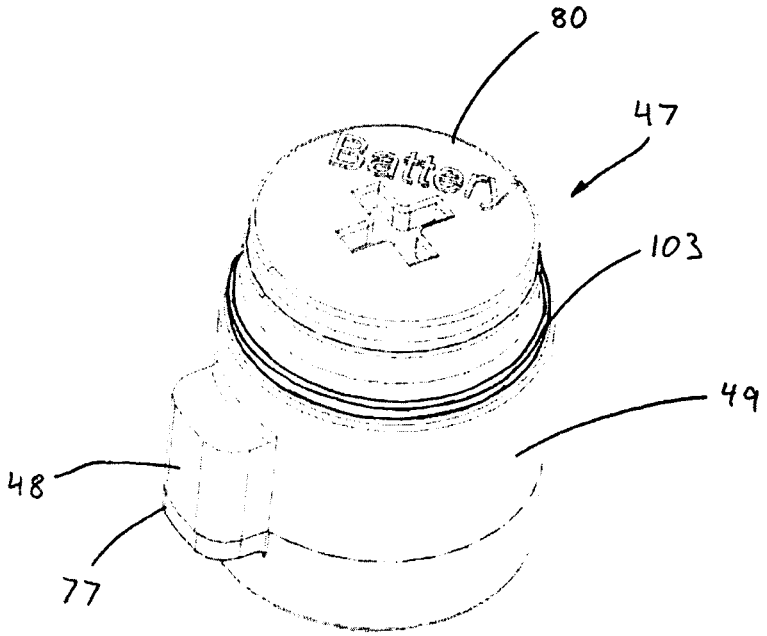
FIG. 15 is a bottom perspective view of the illumination device of FIG. 14.

Turning now to FIGS. 5, 14 and 15, the illumination device 47 is shown having a generally hollow cylindrical housing 49 which supports the manually operated lighting assembly 84 therein (preferably a high intensity LED module). On one end of the housing 49 is an on/off push button 78 to operate the lighting assembly 84, and on an opposite end thereof is a threaded battery access cover 80 to access the batteries 79 seated within the housing. The push button 78 includes a flexible cover, preferably latex or rubber, having a dome-shaped head portion 81 and a seating collar 82 that extends annularly around the head portion 81.

Figure 16:
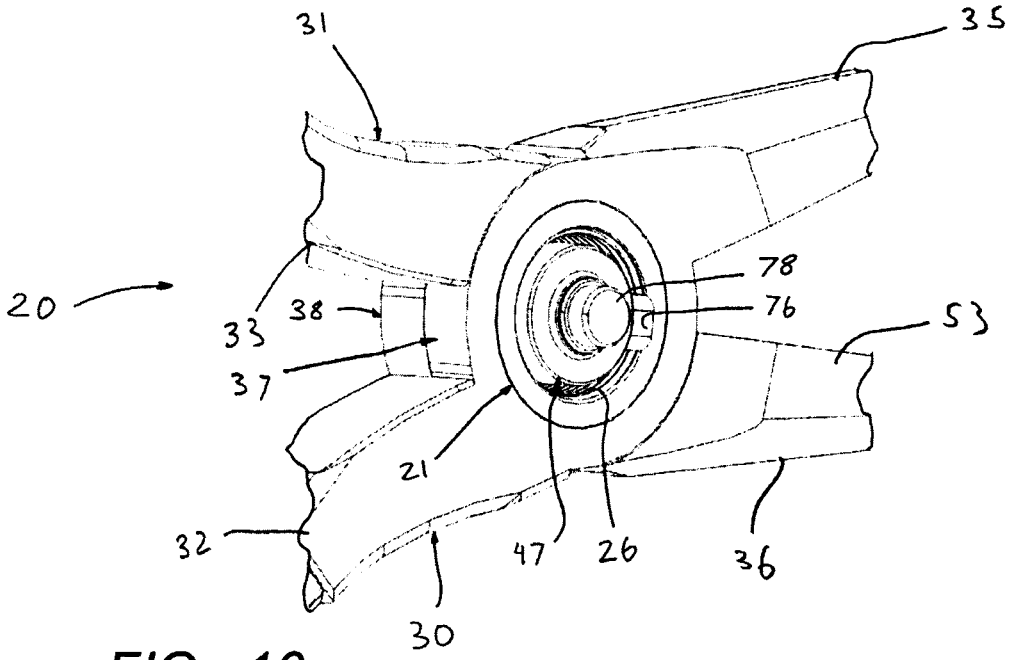
FIG. 16 is an enlarged, fragmentary, rear perspective view of the lighted hand tool apparatus of FIG. 1, without the first end cap installed.
Figure 17:
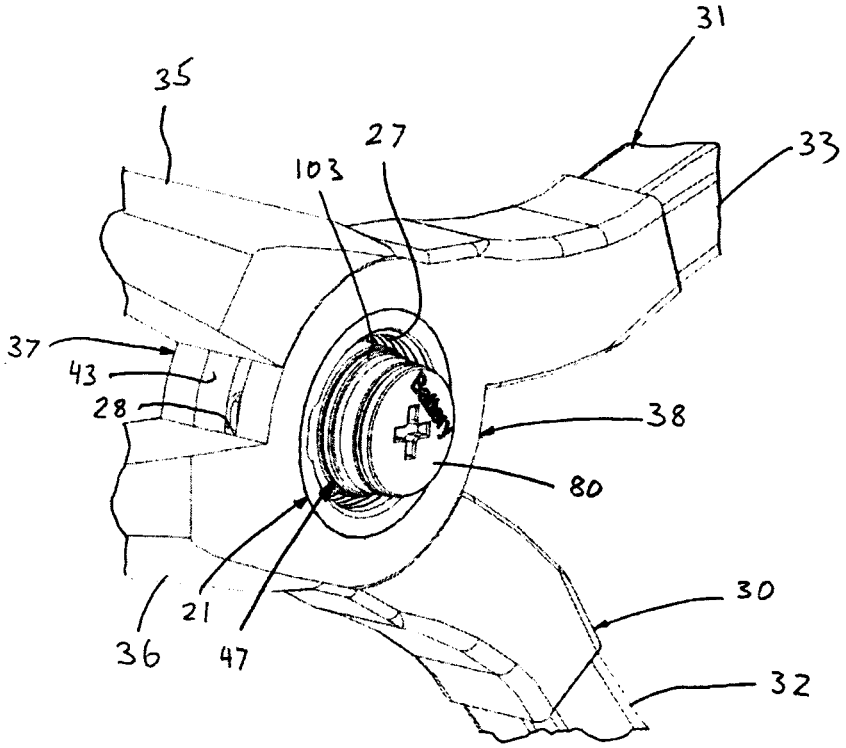
FIG. 17 is an enlarged, fragmentary, opposite rear side perspective view of the lighted hand tool apparatus of FIG. 1, without the second end cap installed.

Protruding radially outward from a side wall of the cylindrical housing 49 is the alignment key portion 77 which houses the output portion 48 of the lighting assembly 84. As also previously indicated, this key portion 77 is formed and dimensioned for sliding axial receipt in the interior alignment slot 76 of the rivet member, aligning the output portion of the light device with the side communication port 28 thereof, and hence, the central passageways 43, 45 of the first and second tool members 30, 31 (FIGS. 5, 16 and 17).

Either the first end cap 50 or the second end cap 51 can be threaded into either bore section 40, 41 of the pivot portion 37, 38 prior to installment of the illumination device 47 in the receiving channel 25 of the rivet member 21. On the other hand, the illumination device 47 can be axially inserted into the rivet receiving channel 25 prior to installment of either end cap 50, 51. It will be appreciated, however, that upon threading engagement of both end caps 50, 51 with the threaded interior wall 23 of the rivet member 21, the end caps cooperate with the housing 49 of the illumination device to sandwich the same therebetween. This cooperating engagement not only axially secures the illumination device, relative to the rivet member, but also secures a water tight seal therebetween.

Figure 18:
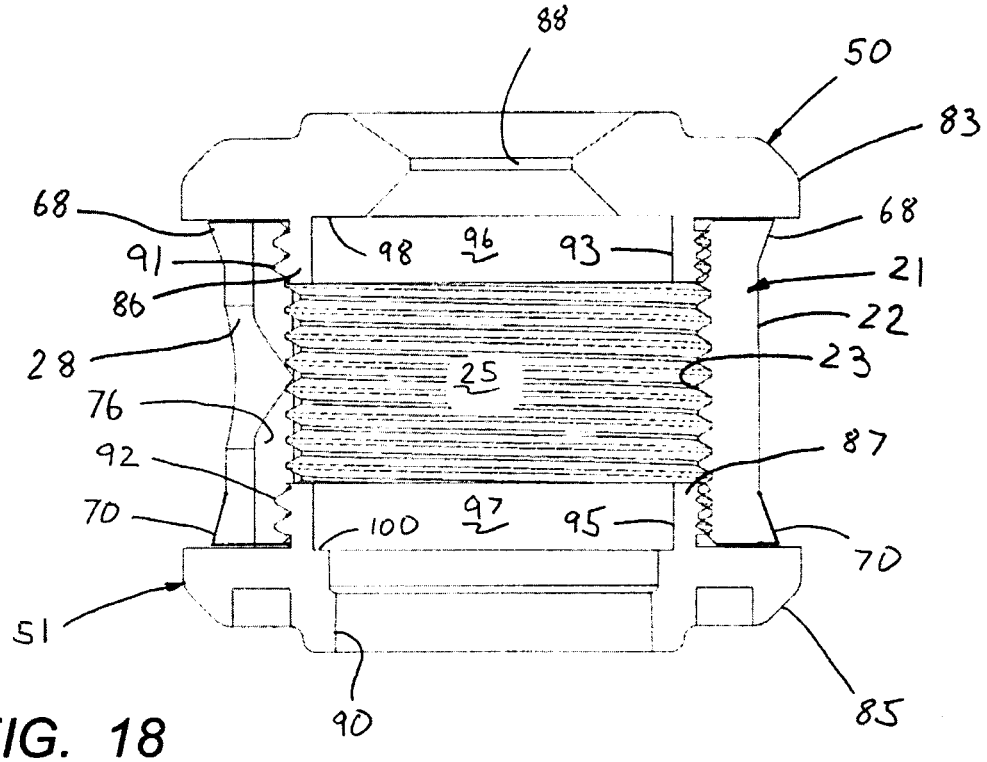
FIG. 18 is an enlarged, top plan view, in cross section, of the assembled rivet member, and first and second end cap of FIG. 13.
Figure 19:
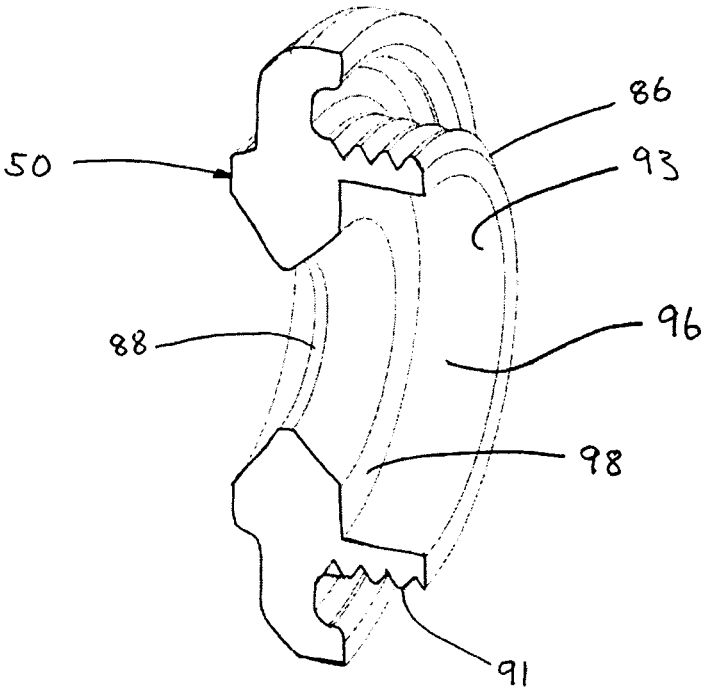
FIG. 19 is an enlarged, bottom perspective view, in cross-section, of the first end cap of the lighted hand tool apparatus of FIG. 1.
Figure 20:
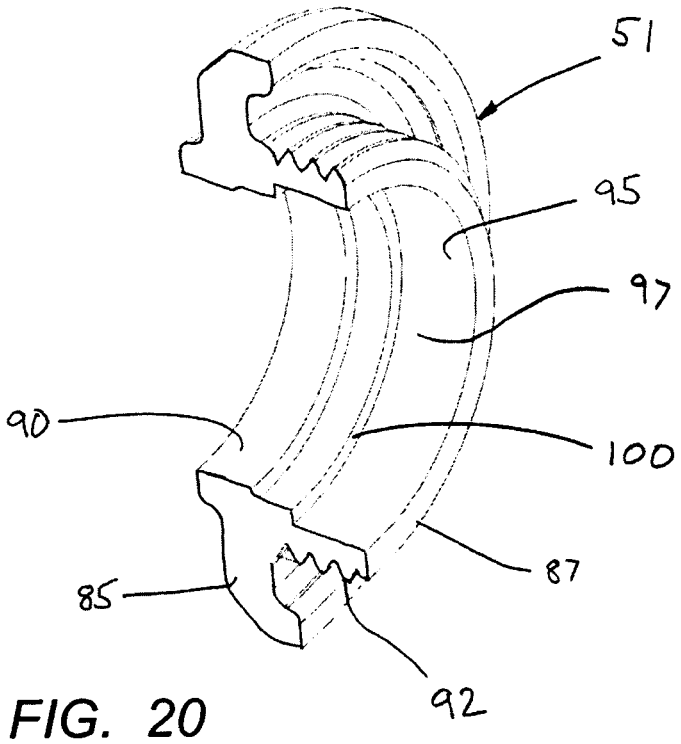
FIG. 20 is an enlarged, bottom perspective view, in cross-section, of the second end cap of the lighted hand tool apparatus of FIG. 1.
Figure 22:
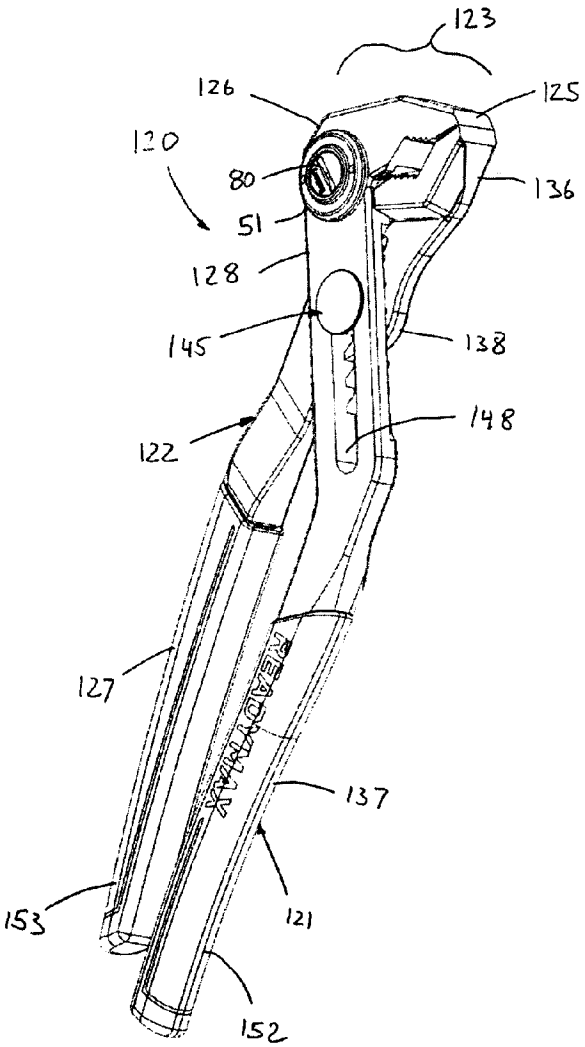
FIG. 22 is an opposite side perspective view of the lighted hand tool apparatus of FIG. 21.
Figure 21:
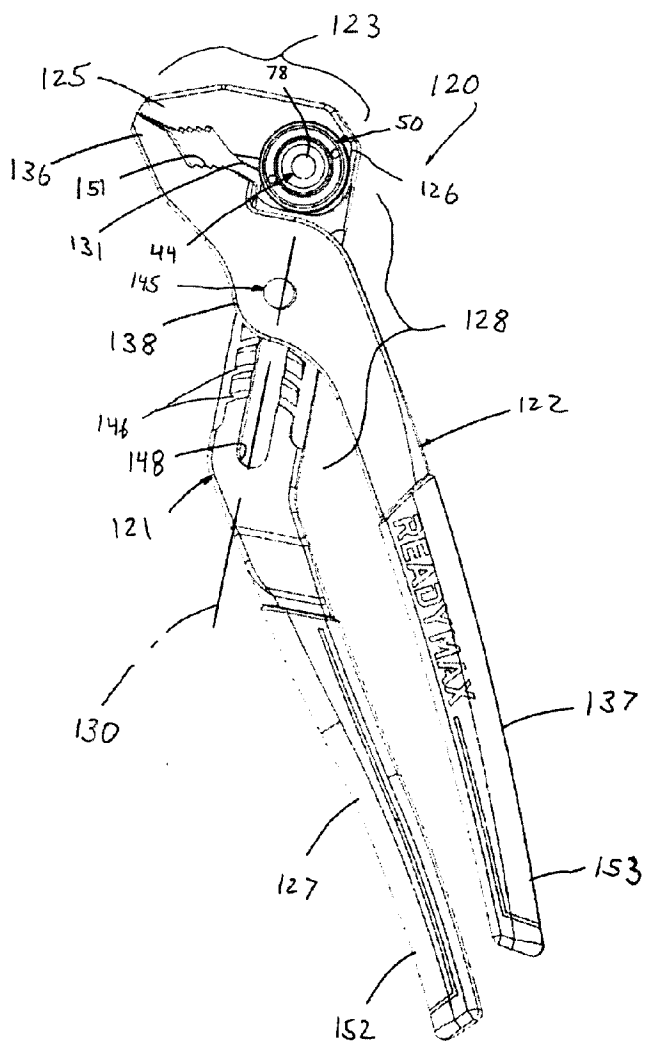
FIG. 21 is a side elevation view of an alternative embodiment lighted hand tool apparatus constructed in accordance with the present invention, illustrated in a closed condition.

As best shown in FIGS. 18-20, each end cap 50, 51 is primarily comprised of a cover disk 83, 85, each having a downwardly depending, annular contact wall 86, 87. The first end cap 50 defines a central button port 88 formed and dimensioned for operable receipt of at least a portion thereof therethrough. Similarly, the second end cap 51 includes a battery cover access port 90 formed and dimensioned to for accessible receipt of the battery cover 80 therethrough. Each annular contact wall 86, 87 includes an exterior facing wall 91, 92 sized and dimensioned for threaded engagement with the respective threaded interior wall 23 of the rivet member 21, and each having an interior facing wall 93, 95 that define a respective receiving recess 96, 97.

At the bottom of each respective recess 96, 97 is a respective annular contact shoulder 98, 100. The annular contact shoulder 98 of the first end cap 50 surrounds, and at least partially defines, the button port 88. Similarly, the annular contact shoulder 100 of the second end cap 51 surrounds, and at least partially defines, the battery cover access port 90.

Each receiving recess 96, 97 is formed and dimensioned for sliding axial receipt of the corresponding ends of the illumination device housing 49 therein. Thus, the head portion 81 of the push button 78 passes through the button port 88 generally until the annular contact shoulder 98 cooperates with, or abuts against, one end of the illumination device housing 49 (FIGS. 5, 18 and 19). Similarly, the battery cover 80 of the illumination device 47 passes through the corresponding cover port 90 generally until the annular contact shoulder 100 of the second end cap cooperates with, or abuts against, the opposite end of the illumination device housing 49 (FIGS. 5, 18 and 20).

The axial length, shape and diametric dimensions of the illumination housing 49 are such that when the first end cap 50 is fully threaded into the first opening 26 of the rivet receiving channel 25, an annular underside flange 101 of the respective cover disk 83 abuts against the corresponding outer facing wall 56 of the pivot portion 37, and the annular contact shoulder 98 of the first end cap 50 also generally simultaneously cooperates with, or abuts against, the one end of the illumination device housing 49 (FIGS. 5, 18 and 19). Again, similarly, when the second end cap 51 is fully threaded into the second opening 27 of the receiving channel 25, an annular underside flange 102 of respective disk portion 85 abuts against the corresponding outer facing wall 57 of the pivot portion 38, and the corresponding annular contact shoulder 100 thereof cooperates with, or abuts against, opposite end of the illumination device housing 49 (FIGS. 5, 18 and 20). Collectively, when both end caps are fully threaded into the corresponding hand tool members, the illumination device 47 is secured and sandwiched therebetween.

In one specific embodiment, at the second end cap 51, an annular gasket or O-ring seal 103 can be provided to extend around the opposite end portion of the illumination housing 49. As best shown in FIGS. 5 and 15, the gasket 103 may be sandwiched between the annular contact shoulder 100 in the second end cap receiving recess 97 and the battery cover end of the illumination device housing 49. When the second end cap 51 is fully threaded into the receiving channel 25 of the rivet member, a moisture resistant barrier is formed.

At the first end cap push button end, the seating collar 82 of the push button 78 itself is utilized to form a moisture barrier therewith. FIGS. 5, 18 and 19 best illustrate that the button access port 88 is hour glass-shaped from a cross-sectional side view. As can be seen, the button port tapers radially inward from the exterior surface of the cover disk 83 towards the center thereof. Similarly, from the interior surface of the receiving recess 96, the button access port tapers radially inward towards the center thereof, both tapers of which terminate to slideable receive the head portion 81 of the push button 78. When the first end cap 50 is fully threaded into the receiving channel 25 of the rivet member 21, the resilient seating collar is sandwiched between the tapered interior surface and the first end cap 50 and an annular button receiving flange 105 of the one end of the illumination housing 49.

Figure 26:
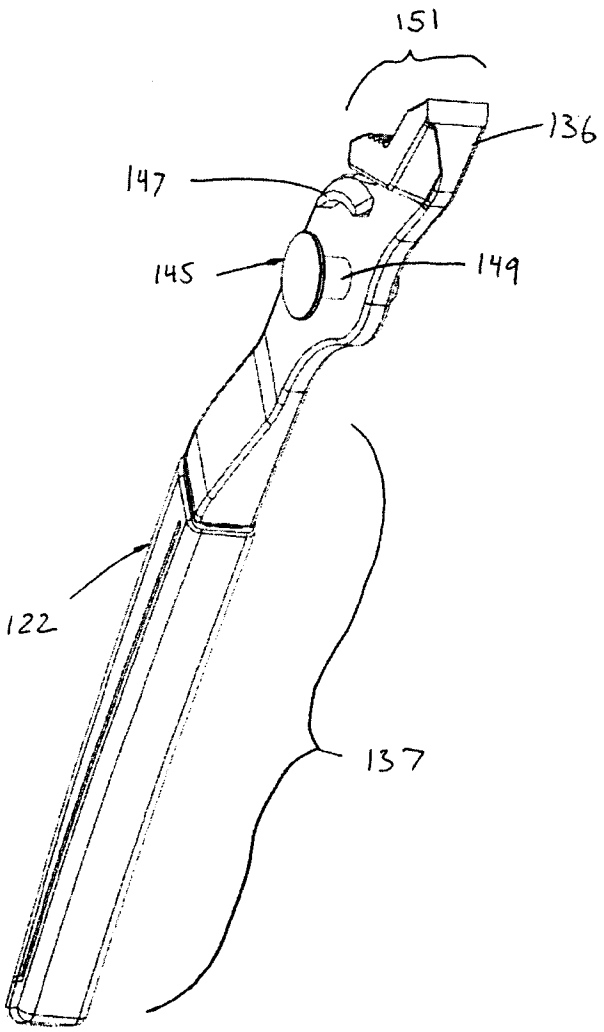
FIG. 26 is an opposite side perspective view of a second tool member of the lighted hand tool apparatus of FIG. 21.
Figure 28:
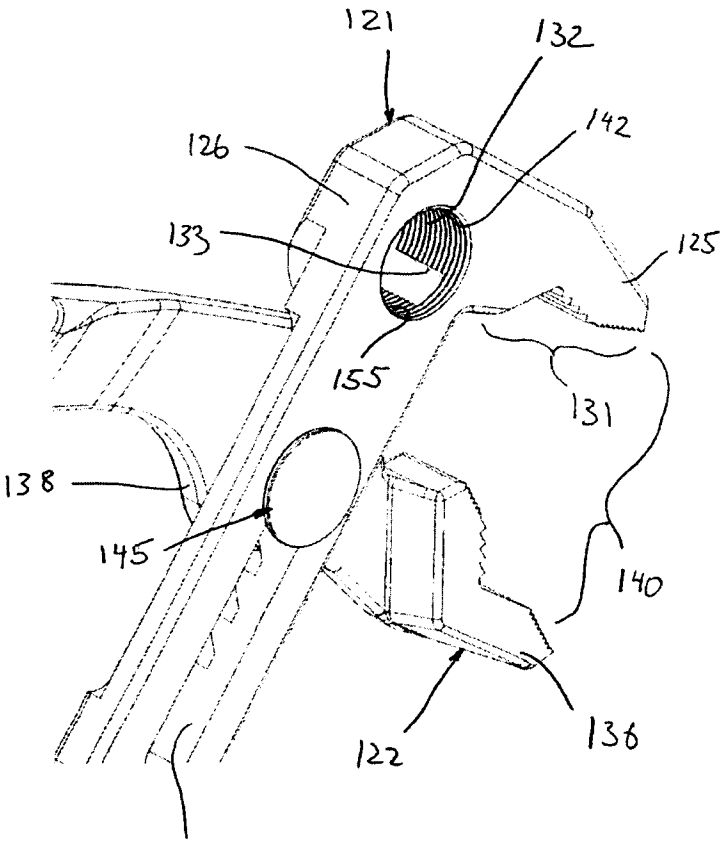
FIG. 28 is an opposite rear perspective view of the lighted hand tool apparatus of FIG. 27.
Figure 27:
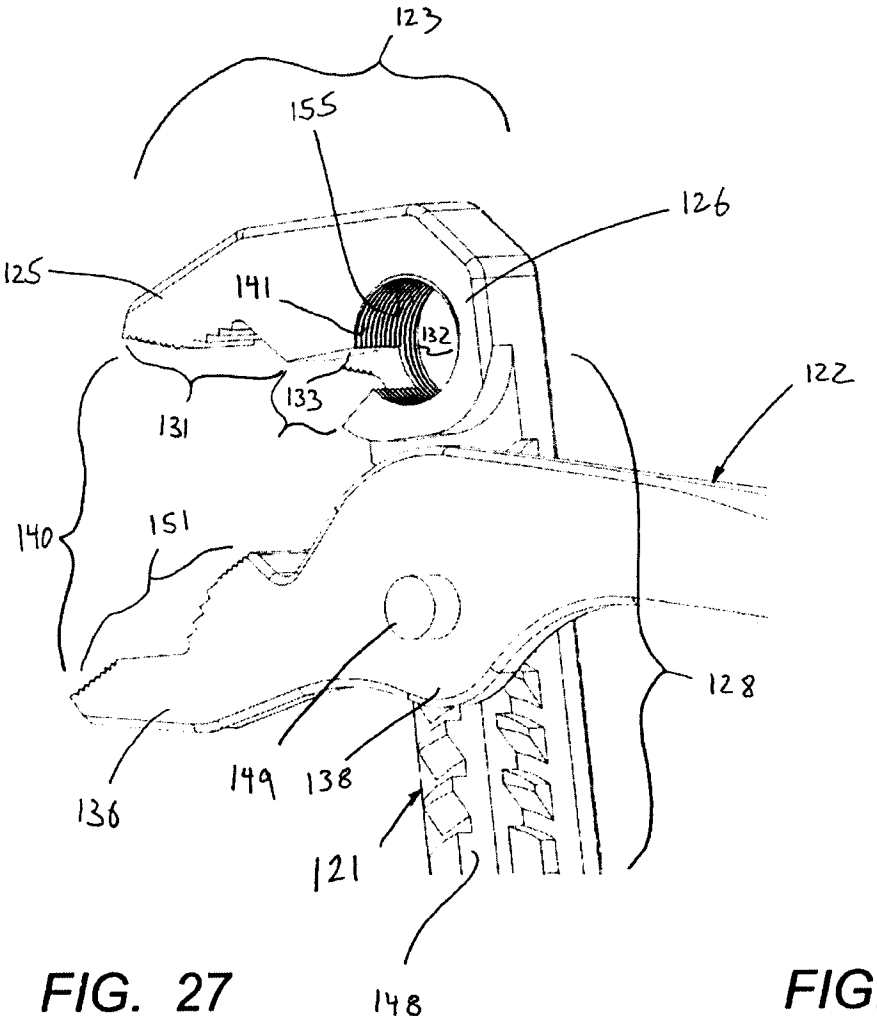
FIG. 27 is an enlarged, fragmentary, rear perspective view of the lighted hand tool apparatus of FIG. 21, without the illumination device.

Turning now to FIGS. 21-28, an alternative embodiment illuminated hand tool apparatus is provided, generally designated 120. This lighted hand tool apparatus 120 includes a first tool member 121 and a second tool member 122, both similarly mounted in a cross-jaw configuration. The first tool member 121 includes a head portion 123 having a first jaw section 125 and an interface section 126. The first tool member 121 further includes a first handle portion 127 and an elongate interlock portion 128 that integrally connects the handle portion 127 to the head portion 123. The elongate interlock portion 128 includes a longitudinal axis 130 and angularly intersects a work surface 131 of the first jaw section 125 at the head portion interface section 126. The interface section 126 further defines a receiving channel 132 extending laterally therethrough from one side of the interface section to an opposite thereof. FIGS. 27 and 28 best show that the head portion further defines a communication channel 133 that extends radially from the receiving channel 132 to an end port 135, terminating at the work surface 131 for light communication therebetween. The second tool member 122 similarly includes a second jaw portion 136, a second handle portion 137 and a coupling portion 138 integral between the second jaw portion 136 and the second handle portion 137. The coupling portion 138 cooperates with the elongate interlock portion 128 to movably couple the second tool member 122 to the first tool member 121 in a crossed orientation such that the first and second jaw portions 125, 136 are offset to one side of the longitudinal axis 130 of the elongated interlock portion. The coupling portion 138 is further manually movable along the longitudinal axis 130 of the elongated interlock portion 128 to adjust the size of the work area 140 defined between the first and second jaw portions.

An illumination device 47, similar to that disclosed above, is included having the illumination output portion 48 that outputs a direct light beam therefrom. The illumination device 47 includes the housing 49 that is formed and dimensioned for removable, axial sliding receipt in the receiving channel 132 of the interface section 126 such that the output portion is aligned with the communication channel 133. The illuminated hand tool apparatus 120 further includes a first end cap 50 disposed in a first opening 141 into receiving channel 132, and a second end cap 51 disposed in an opposite second opening 142 into the receiving channel 132. The first end cap and the second end cap cooperate to securely abut and seat the illumination device therebetween.

Figure 24:
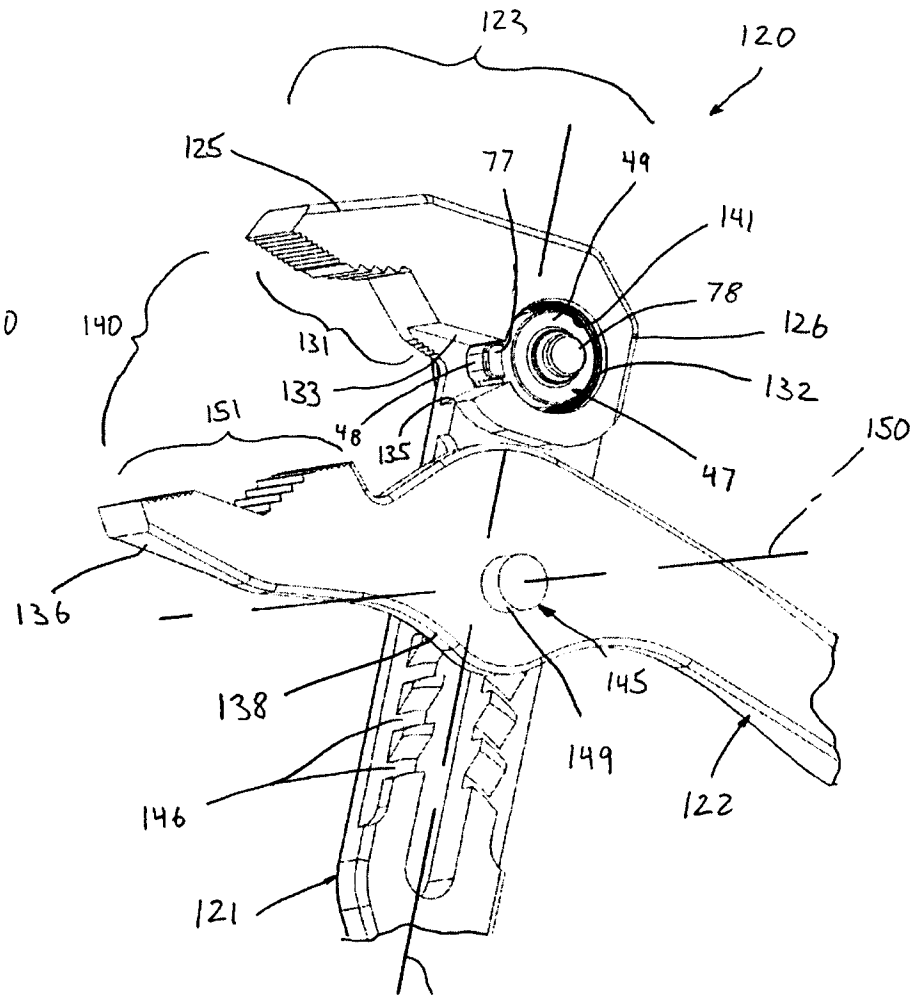
FIG. 24 is a side perspective view of the lighted hand tool apparatus of FIG. 23.
Figure 23:
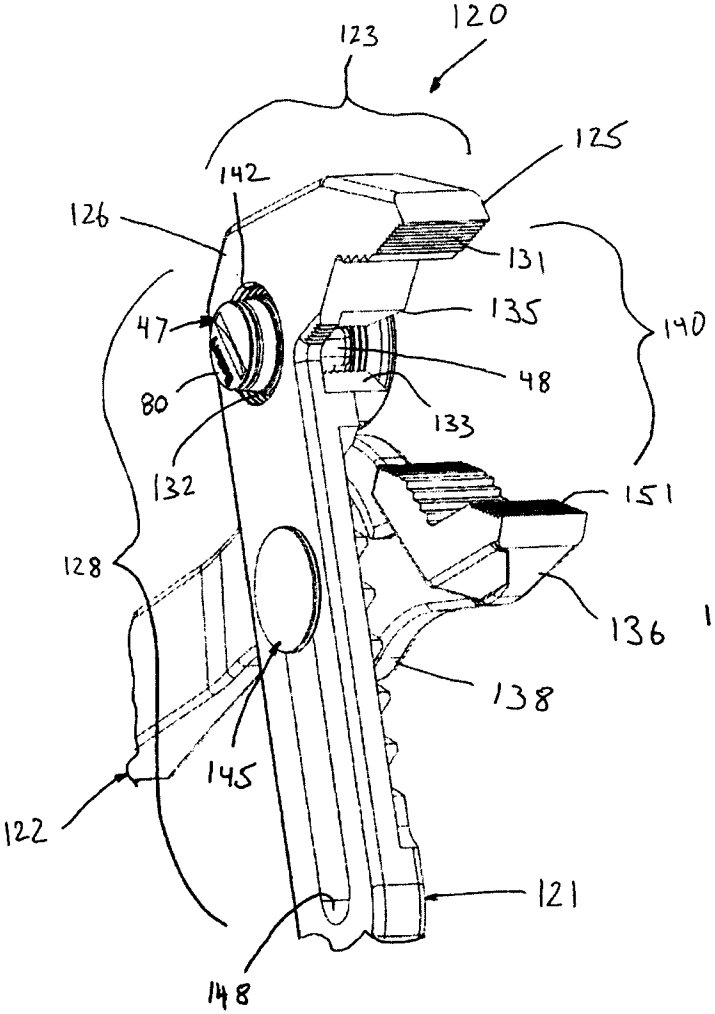
FIG. 23 is an enlarged, fragmentary, front perspective view of the lighted hand tool apparatus of FIG. 21, in an opened condition.

Accordingly, as best shown in FIGS. 23 and 24, a tongue and groove-style plier device is provided that similarly houses an illumination device capable of illuminating the work area. Briefly, tongue & groove pliers are a type of slip-joint pliers that have a large mouth size. The jaws on these pliers can open to multiple widths by moving, or slipping, the pivot into corresponding grooves 146. It will be appreciated, however, that this aspect of the present invention can be used in other hand operated tools of this shape such as a pipe wrench, as will be described below.

Referring back to FIGS. 25-28, as mentioned, a conventional tongue and groove plier hand tool apparatus 120 is shown having the first tool member 121 and the second tool member 122 pivotally joined at the coupling portion 138 and the interlock portion 128, by a nut assembly 145. Briefly, one side of the interlock portion 128 includes a plurality of conventional arcuate grooves 146 spaced-apart along the longitudinal axis 130 thereof, as well as an elongated slot 148, also extending along the direction of the axis. In contrast, the opposed engaging side of the coupling portion 138 includes an arcuate tongue portion 147 formed and dimensioned for sliding receiving in one of the mating grooves, when aligned therewith (FIG. 26).

The nut assembly 145 includes a bolt 149 having a shaft that traverses the elongated slot, allowing the second tool member 122 to rotate about the rotational axis 150 of the bolt 149. This assembly, similar to all tongue and groove designs, also allow the second tool member 122 to slide longitudinally along the slot 148 when the arcuate tongue portion 147 of the coupling portion 138 is sufficiently rotated about the rotational axis 150, out of engagement with the arcuate grooves 146.

Similar to the previous embodiment each hand tool member 121, 122, is preferably comprised of a metallic material, for strength purposes, and is more preferably comprised of stainless steel. It will be appreciated, however, that the hand tools may be composed of other lightweight, synthetic or exotic materials. Also, similar to the previous embodiment, each of the first jaw section 125 and the second jaw section 125 includes an opposed corresponding work surface 131, 151 that collectively define the work area 140 when the hand tool members 121, 122 are operationally interconnected about the nut assembly 145. While the shape and of the work surfaces 131, 151 are shown as being relatively rectangular and substantially planar, these dimensions may be varied, and the work surfaces may be conventionally teethed, kneeled or ridged to promote frictional gripping.

Figure 25:
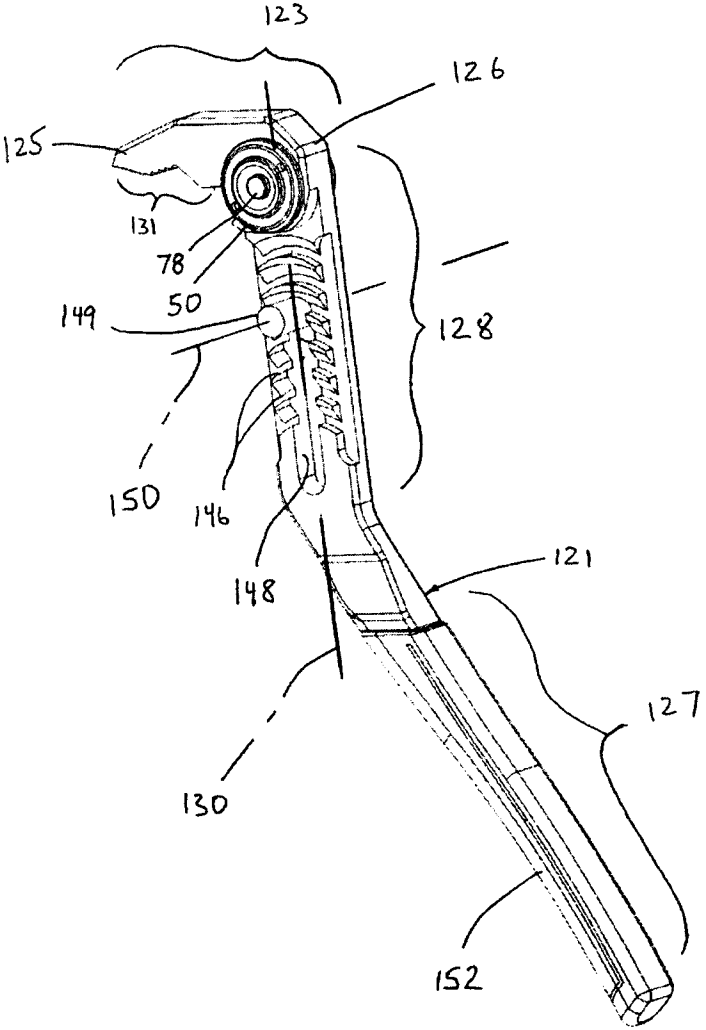
FIG. 25 is a side perspective view of a first tool member of the lighted hand tool apparatus of FIG. 21.

With respect to the corresponding first and second handle portions 127, 137, each is relatively linear (i.e., FIGS. 25, 26). It will be understood, however, that the handle portions could be curved, as well. Moreover, the handle portions 127, 137 may be knurled or textured to enhance gripping, or may include plastic or rubber sleeves and grips 152, 153, as shown, also to promote gripping and comfort.

Briefly, it will be appreciated that the illumination device utilized in this embodiment of the present invention is substantially the same or identical to the illumination device 47 as shown in FIGS. 14 and 15. Moreover, the first and second end caps 50, 51 of this embodiment are also substantially the same or identical to the those illustrated in FIGS. 13, and 18-20. Accordingly, each of these components will not be described in detail again.

Referring back to FIGS. 27 and 28, the receiving channel 132 of the head portion 123 is oriented generally adjacent the interior corner (interface section 126) of the first tool member 121 where the head portion and the upper distal end of the elongate interlock portion 128 intersect. The diameter of the interior wall 155 is sized and dimensioned for sliding axial receipt of the housing 49 of the illumination device 47 therein. Moreover, as described above and as shown in FIGS. 23 and 24, the communication channel 133 is further formed and dimensioned for sliding axial receipt of an alignment key portion 77 of the illumination device housing 49 therein, aligning the output portion 48 of the illumination device 47 with the work surface 131 of the first tool member. In turn, this prevents rotation of the illumination device 47 within the receiving channel 132.

In one specific configuration, the light communication channel 133 tapers radially outward from the receiving channel thereof to the end port 135, which terminates as the work area 140. This gradual taper facilitates light dispersion so that the light output portion 48 can directly illuminate the workspace between the jaws without substantially any obstruction. In one specific embodiment, the height of the rectangular communication channel, at the proximal opening at the receiving channel 132, may be in the range of about 0.21" to about 0.23", and tapers outward at about a 30 deg angle, relative to a horizontal plane.

In accordance with the present invention, the first and second end caps 50, 51 cooperate with the interior wall 155 of the interface section 126 and the housing 49 of the illumination device 47 to sandwich the same therebetween, securely seating the illumination device in the receiving channel (as mentioned above) Accordingly, the width of the interface section from the one side to the opposite side thereof, together with the illumination device housing 49 dimensions, and the end caps 50, 51 all cooperate for seated interengagement, similar to that mentioned above with the cross-jaw pliers embodiment, when fully assembled Thus, on the first end cap 50 side, the push on/off button 78 of the illumination device 47 will be accessible through the button port 88. Similarly, on the second end cap side, the battery cover 80 will be accessible via the cover access port 90 (FIGS. 13-15).

Preferably, the interior wall 155 of the receiving channel are threaded, and threadably engage the threaded exterior facing walls 91, 92 of the respective contact walls 86, 87 of the first and second end caps 50, 51. It will be appreciated, however, that alternative embodiment the end caps can be removably mounted to the corresponding sides of the interface section 126 by machine screws or the like.

Figure 29:
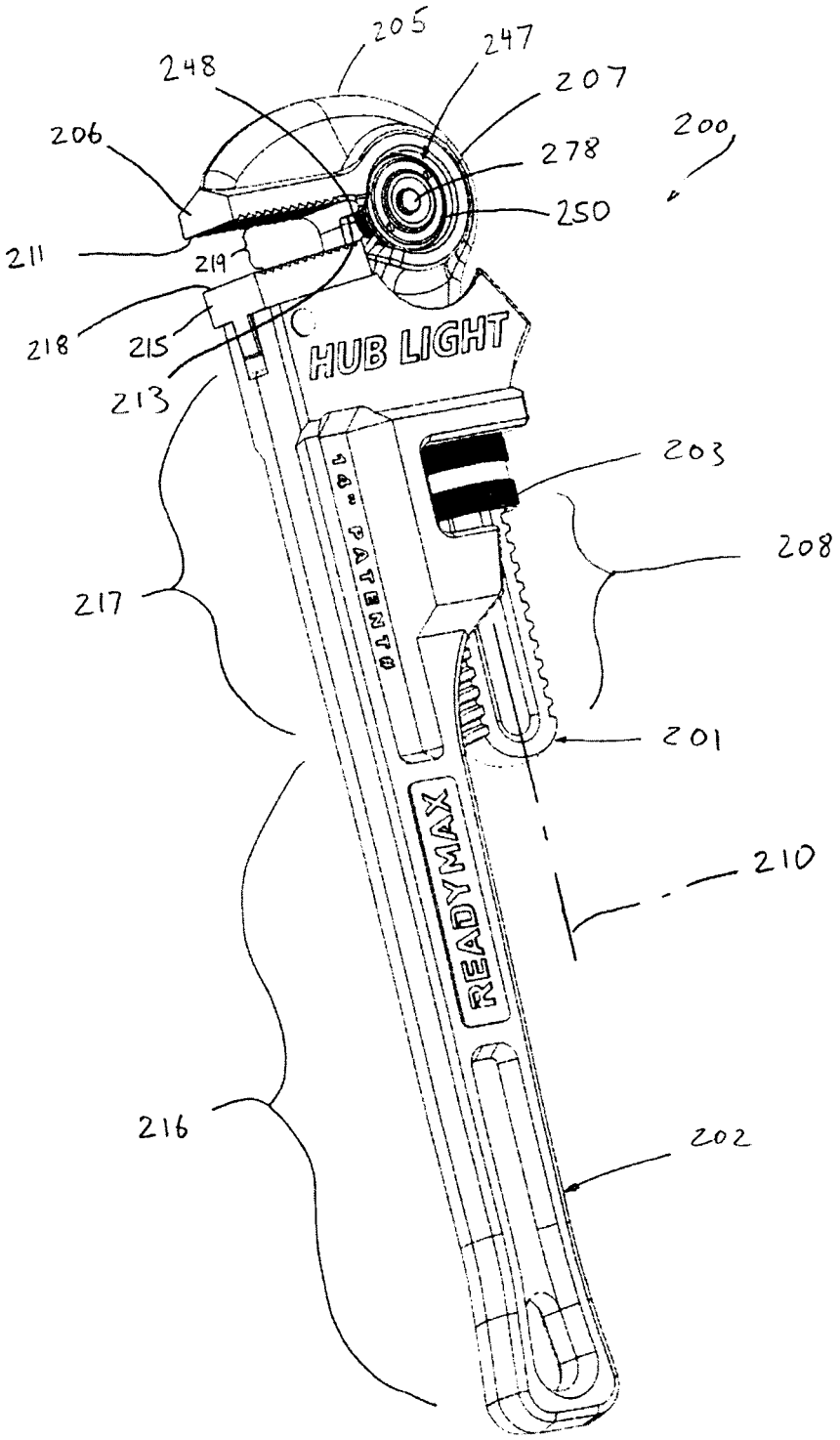
FIG. 29 is a side perspective view of an alternative embodiment lighted pipe wrench tool apparatus constructed in accordance with the present invention.
Figure 30:
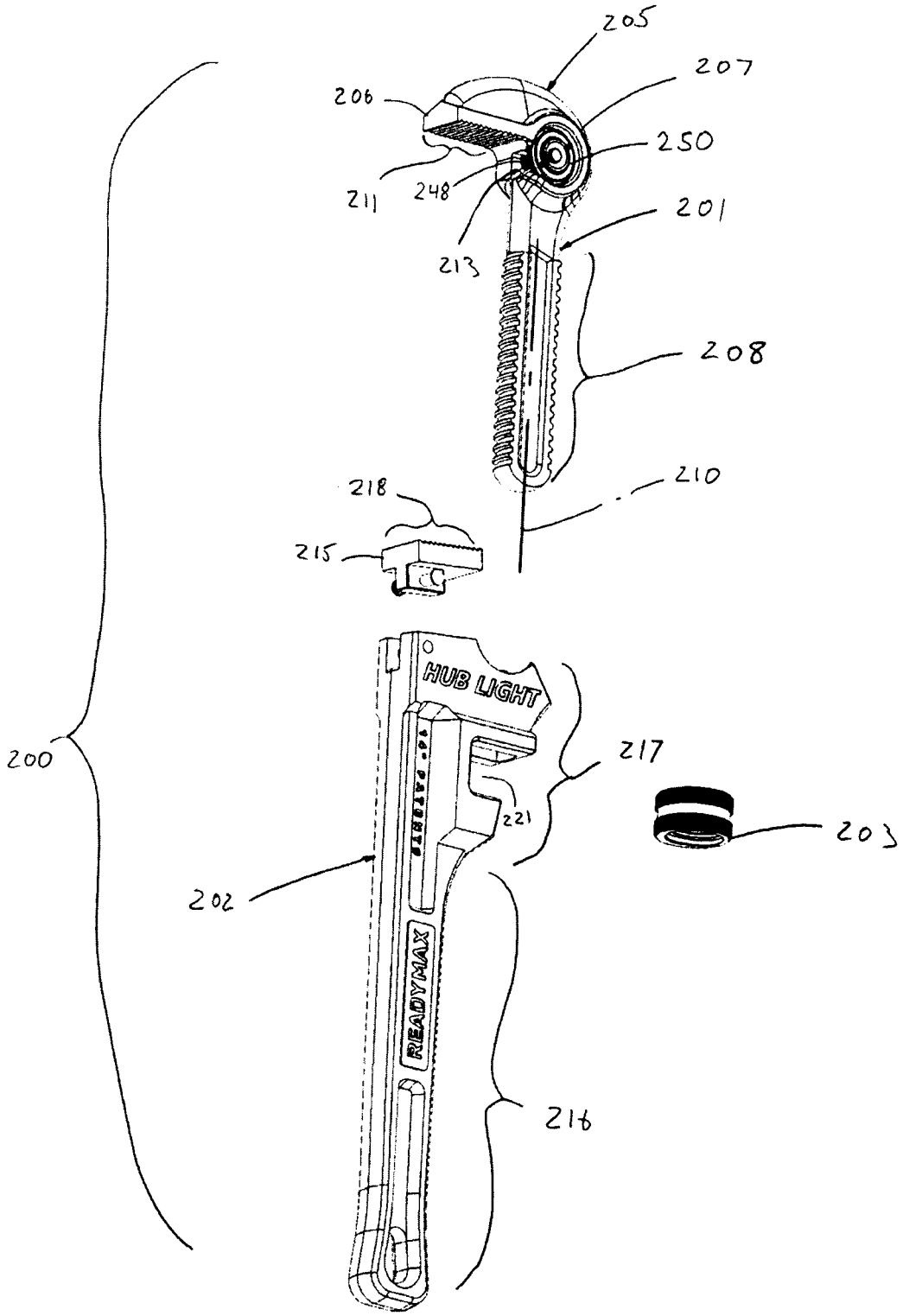
FIG. 30 is an exploded, bottom perspective view of a first wrench member and second wrench member of the lighted pipe wrench tool apparatus of FIG. 29.
Figure 32:
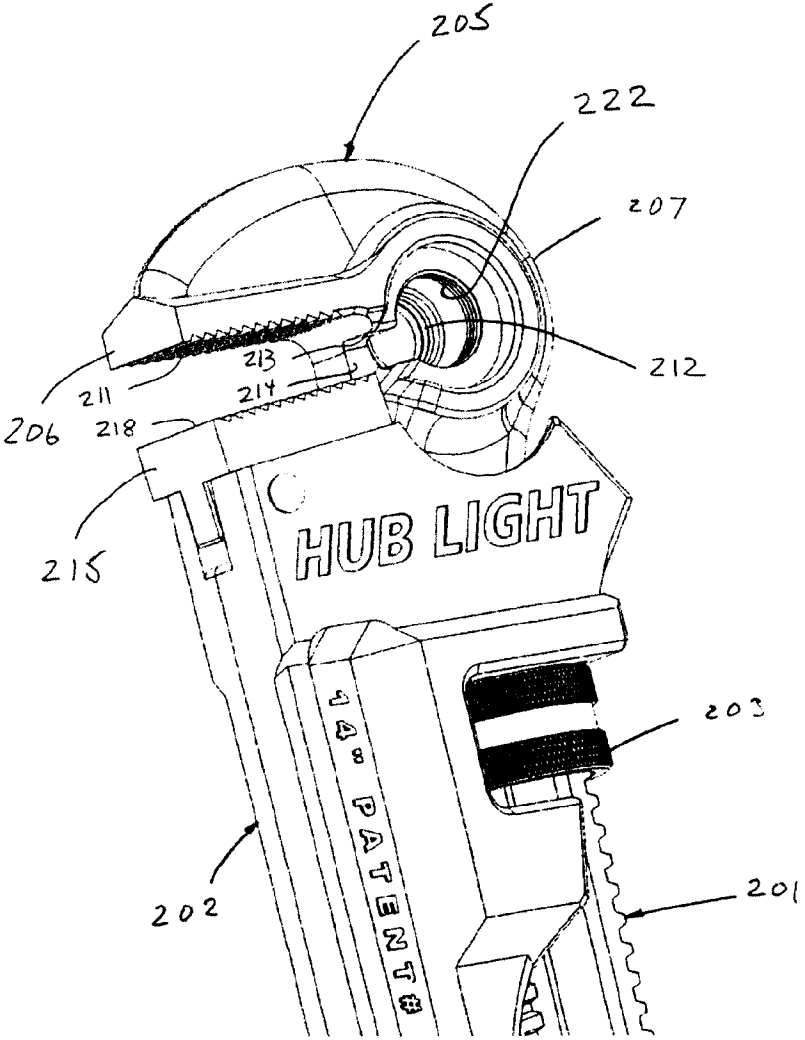
FIG. 32 is a fragmentary, side perspective view of the lighted pipe wrench tool apparatus of FIG. 31 with an illumination device and a second end cap removed.
Figure 31:
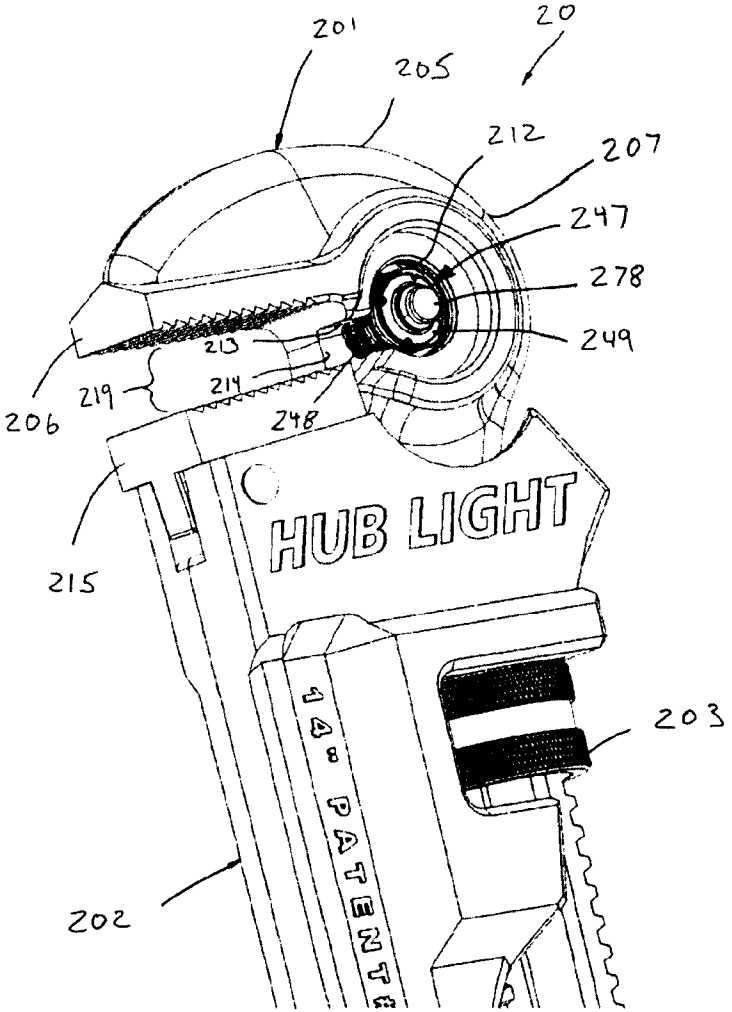
FIG. 31 is an enlarged, fragmentary, side perspective view of the lighted pipe wrench tool apparatus of FIG. 29 with a first end cap removed.
Figure 34:
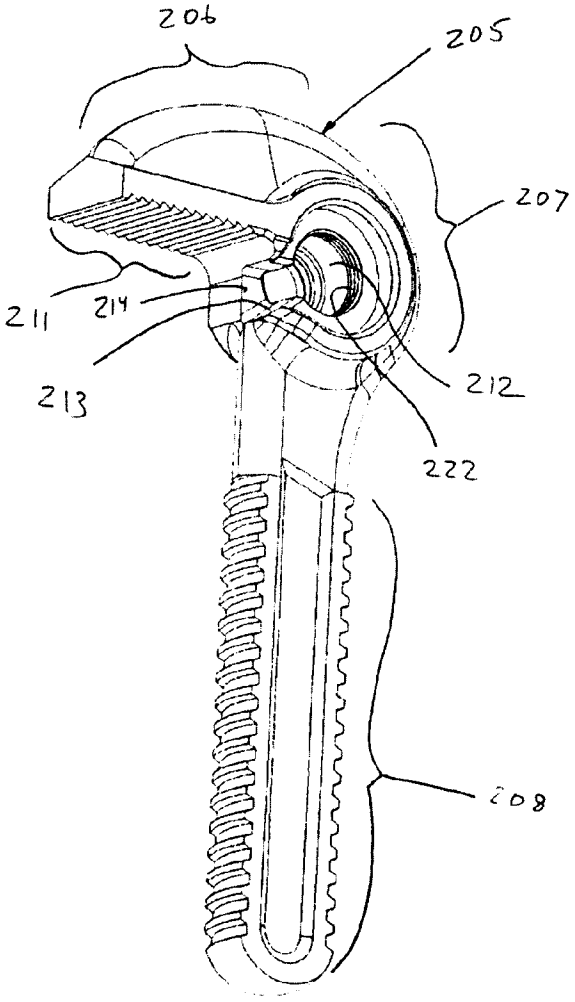
FIG. 34 is an enlarged side perspective view of the first wrench member of the lighted pipe wrench tool apparatus of FIG. 29.

Referring now to FIGS. 29-35, an illuminated pipe wrench assembly 200 is provided having an illumination design similar to that of the tongue and groove pliers embodiment of FIGS. 22-28. FIGS. 29 and 30 best illustrate that the pipe wrench assembly 200 is generally a conventional or traditional straight pipe wrench configuration, including a first wrench member 201 and a second wrench member 202 cooperatively joined together by a nut device 203. The first wrench member 201 includes a head portion 205 having a first jaw section 206 and an interface section 207, and further includes an elongate neck portion 208 having a longitudinal axis 210. The elongate neck portion 208 is preferably threaded, and angularly intersects a work surface 211 of the first jaw section 206 at the head portion interface section 207, generally at a right-angle therebetween. The interface section 207 further defines a receiving channel 212 extending laterally therethrough from one side of the interface section 207 to an opposite side thereof. FIGS. 31, 32, and 34 best show that the interface section 207 further defines a communication channel 213 that extends radially from the receiving channel 212 to an end port 214. The end port 214 terminates at the work surface 211, and provides light communication between the work surface and the communication channel 213.

The second wrench member 202 similarly includes a second jaw section 215, a handle portion 216 and a coupling portion 217 integral between the second jaw section 215 and the handle portion. The coupling portion 217 cooperates with the threaded elongate neck portion 208, via nut device 203, to movably couple the first wrench member 201 to the second wrench member 202, enabling height adjustment of the first jaw section 206 relative to the second jaw section 215 substantially along the longitudinal axis 210 of the neck portion. Moreover, the first and second jaw portions 206, 215 are in aligned and opposed relationship to one another, collectively defining a work area 219 that can be selectively adjust in size via, manual adjustment of the nut device 203.

In accordance with the present invention, a primary illumination device 247 is provided, similar to those disclosed above, which illuminates the work area 219. Briefly, it will be appreciated that the primary illumination device, as well as the secondary illumination device 347 (to be discussed below) for all extensive purposes, is near identical to the illumination device 47 applied in the plier embodiments above as well as that shown in FIGS. 14 and 15. This also applies to the first and second end caps, only first end cap 250 of which is shown (to be discussed), and first and second end covers, only first end cover 350 of which is shown (also to be discussed), the number of which has been changed for clarity.

Figure 39:
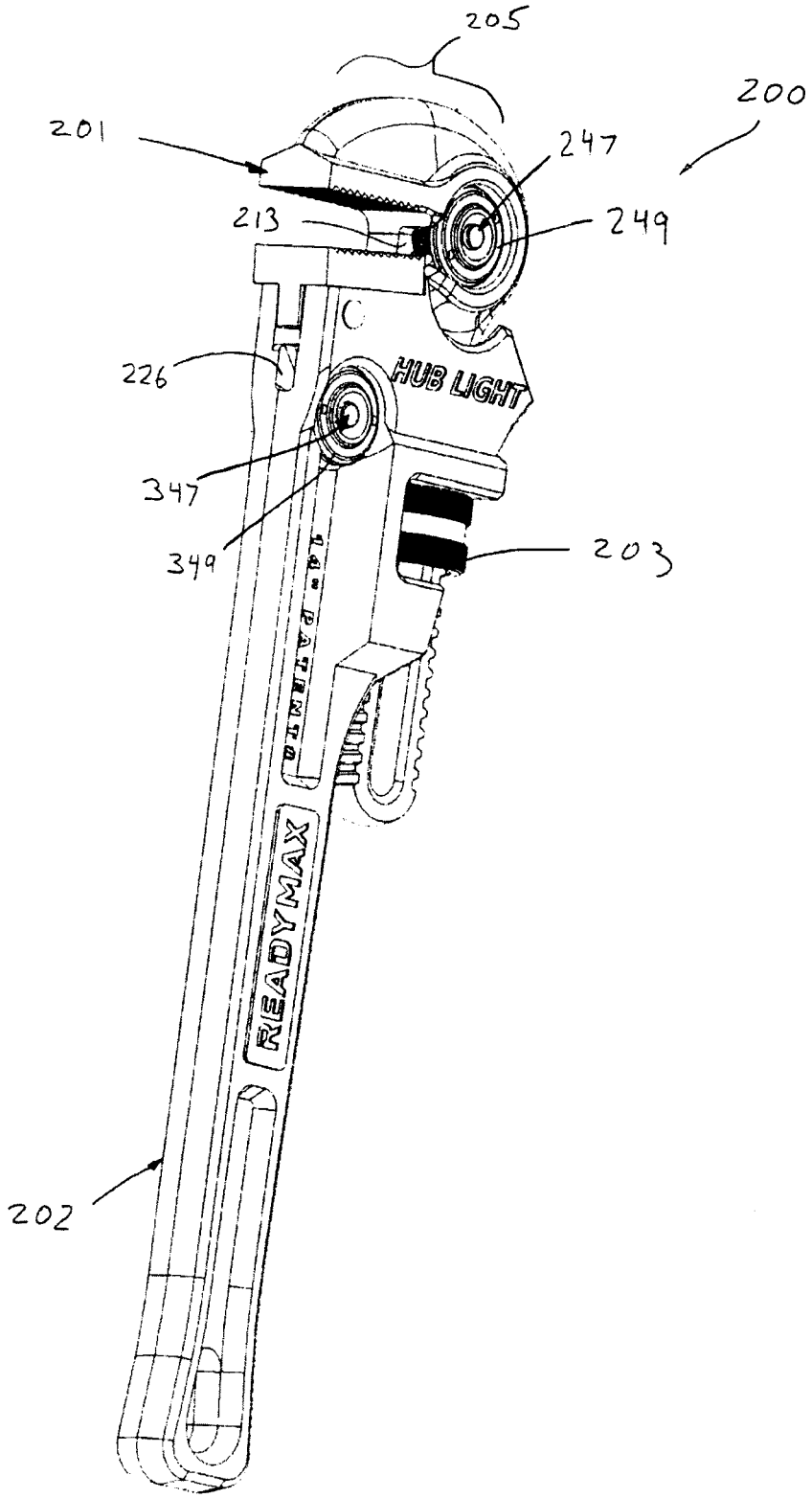
FIG. 39 is a side perspective view of still another alternative embodiment lighted pipe wrench tool apparatus incorporating both the illumination device housed in the first wrench member and the light device housed in the second wrench member.

The primary illumination device 247, as best viewed in FIGS. 30, 31 and 39, includes an illumination output portion 248 that outputs a direct light beam therefrom. The illumination device 247 also includes a housing 249 that is formed and dimensioned for removable, axial sliding receipt in the receiving channel 212 of the first wrench member interface section 207 such that the illumination output portion 248 (via the alignment key portion) is aligned with the communication channel 213. Accordingly, the light beam output from the illumination device 247 can be output the work area 219.

To secure the illumination device 247 within the first wrench member 201, the illuminated pipe wrench assembly 200 further includes a first end cap 250 threadably disposed into a first opening of the receiving channel 212. Similarly, a second end cap is disposed into an opposite second opening of the receiving channel 212. Collectively, the first end cap 250 and the second end cap, together with the axial dimension of the illumination device 247, cooperate to securely abut and seat the illumination device therebetween within the interface section (as similarly shown in FIG. 5).

Accordingly, a pipe wrench style tool is provided that similarly houses an illumination device (similar to the tongue and groove pliers above) capable of illuminating the work area. Briefly, while the pipe wrench tool shown and described represents a more conventional and traditional straight pipe wrench, it will be appreciated that other less conventional pipe wrench assemblies may incorporate the illumination devices as herein described.

As best shown in FIGS. 30 and 34, the work surface 211 of the first jaw section 206 and the longitudinal axis 210 of the neck portion 208 are generally oriented generally perpendicular to one another. The neck portion 208 is threaded, sized and pitched to threadably engage nut device 203. Accordingly, the longitudinal movement of the first wrench member 201 relative to a work surface 218 of second jaw section 215 is also generally perpendicular thereto.

As mentioned, the second wrench member 202 is comprised of second jaw section 215, a coupling portion 217 and an elongated handle portion 216 extending generally perpendicular to the work surface 218 of the second jaw section. The coupling portion 217 defines an alignment channel 220 extending from an upper portion of the coupling portion to a lower portion thereof. The alignment channel 220 is formed and dimensioned for axial sliding receipt of the neck portion 208 of the first wrench member 201 therethrough which enables relative reciprocating movement of the first work surface 211 toward and away from the opposed second work surface 215.

Figure 38:
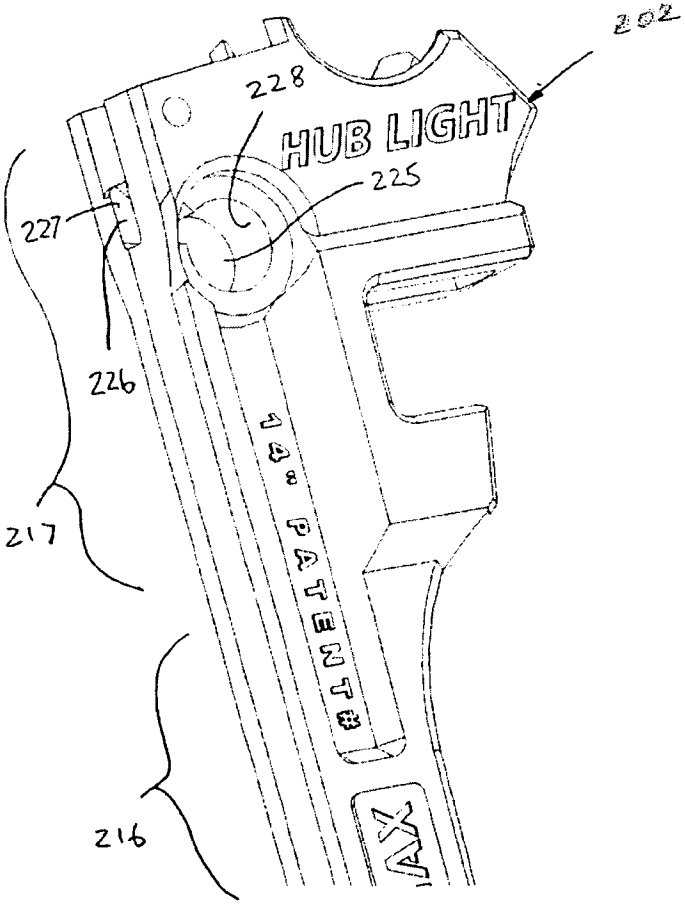
FIG. 38 is a fragmentary, bottom perspective view of the second wrench member of the pipe wrench tool apparatus of FIG. 37 with a light device and a second end cover removed.
Figure 37:
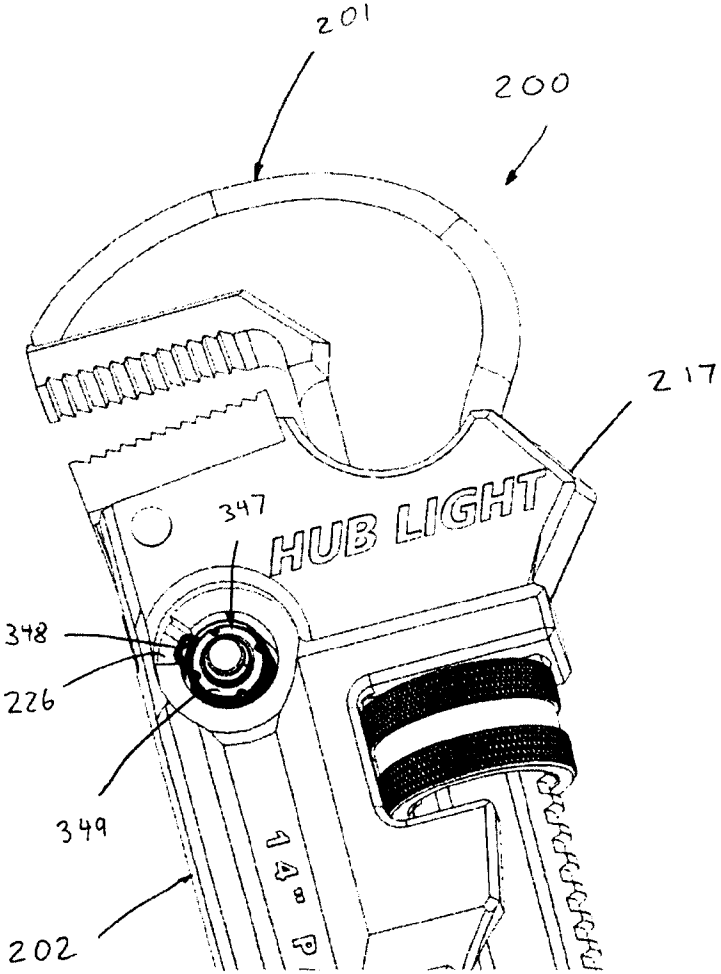
FIG. 37 is an enlarged, fragmentary, bottom perspective view of the lighted pipe wrench tool apparatus of FIG. 36 with a first end cover removed.

The coupling portion 217 further provides a receptacle 221 (FIG. 38) formed and dimensioned for disposal of the nut device 203 therein in a manner aligning the axis of the nut device with that of the alignment channel 220. The upper and lower ledge portions defining the receptacle limit axial movement of nut device, and accordingly enable movement of the first wrench member 201 relative to the second wrench member 202 as the nut device is rotated. The jaws sections of the pipe wrench can thus be moved back and forth to adjust the width of the work area, accommodating pipes of different diameters.

Similar to the previous plier tool embodiments each wrench member 201, 202 is preferably comprised of a metallic material, for strength purposes, and is more preferably comprised of stainless steel. It will be appreciated, however, that the hand tools may be composed of other lightweight, synthetic or exotic materials. While the shape and of the work surfaces 211, 215 are shown as being relatively rectangular and planar, these dimensions may be varied, and the work surfaces may be conventionally teethed, kneeled or ridged to promote frictional gripping.

While the handle portion 216 of the second wrench member 202 is shown to be relatively linear (i.e., FIGS. 29 and 30), it will be understood that the handle portion could be curved, as well. Moreover, the handle portion 216 may be knurled or textured to enhance gripping, or may include plastic or rubber sleeves and grips to promote gripping and comfort.

As mentioned, the illumination device 247 utilized in this embodiment of the present invention is substantially the same or identical to the illumination device 47 as shown in FIGS. 14 and 15. Moreover, the first end cap 250 and second end cap of this embodiment are also substantially the same or identical to the caps 50 and 51 illustrated in FIGS. 13, 18-22. Accordingly, again, each of these components will not be described in detail again.

Figure 33:
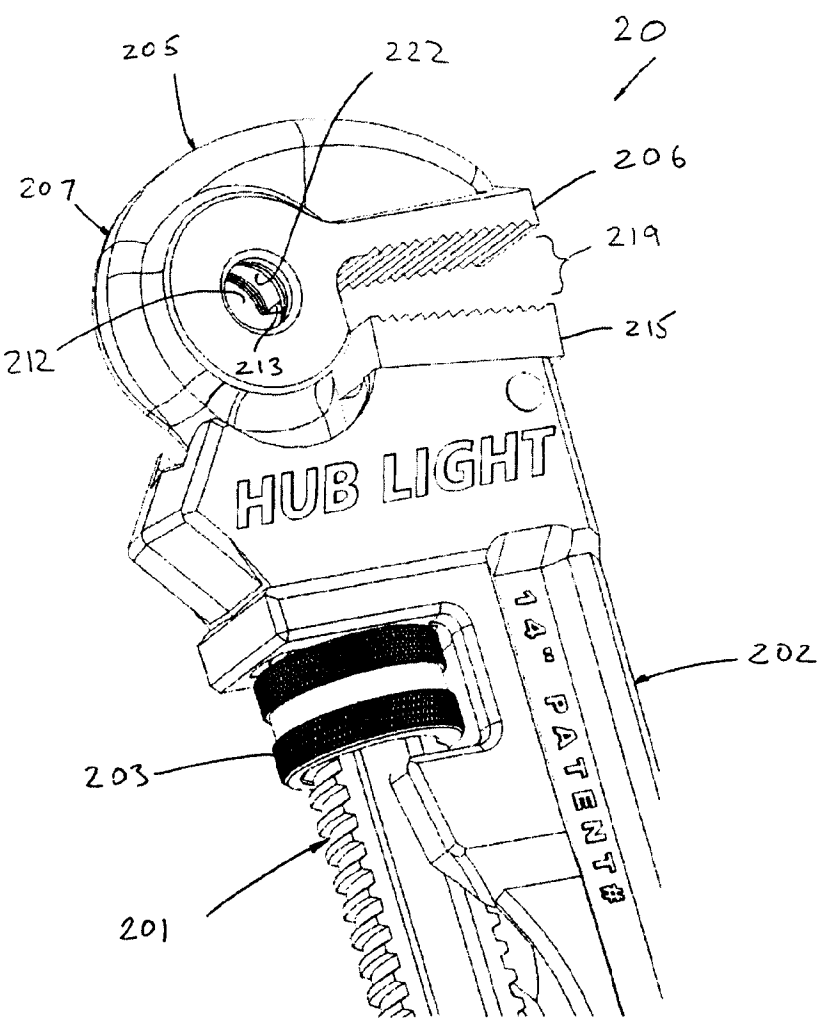
FIG. 33 is a fragmentary, opposite side perspective view of the lighted pipe wrench tool apparatus of FIG. 32.
Figure 36:
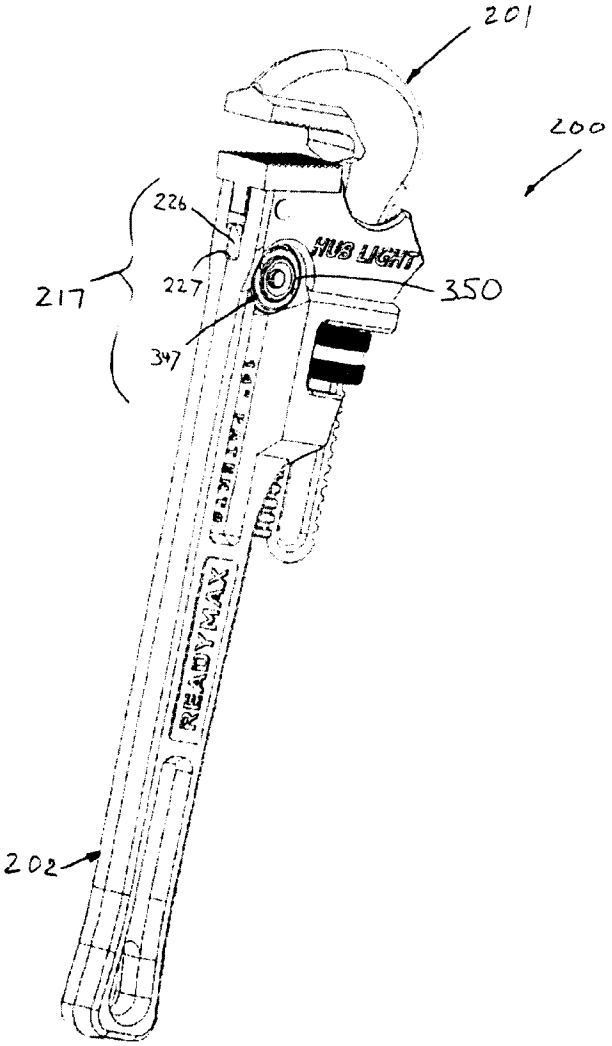
FIG. 36 is a side perspective view of another alternative embodiment lighted pipe wrench tool apparatus with the light device housed in the second wrench member.
Figure 35:
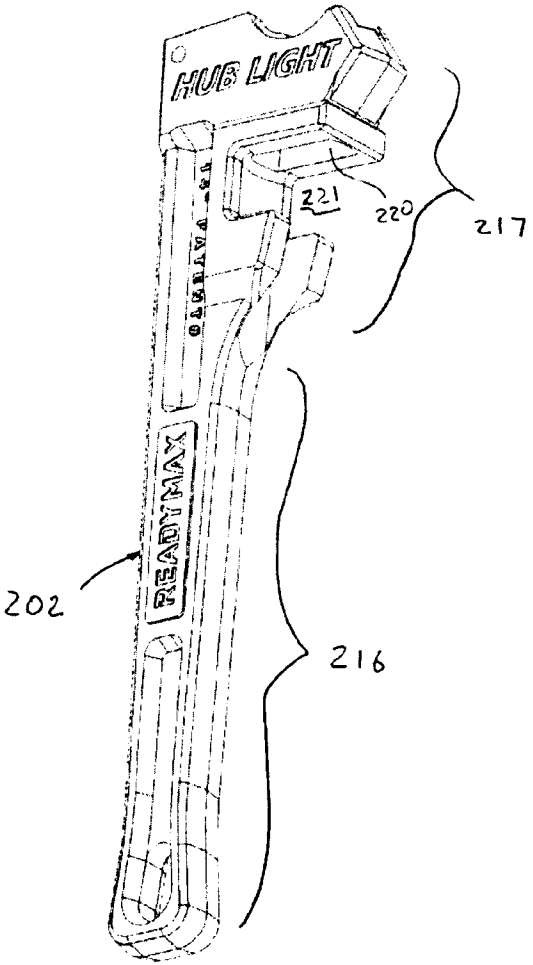
FIG. 35 is an enlarged opposite side perspective view of the second wrench member of the lighted pipe wrench tool apparatus of FIG. 29.

Referring now to FIGS. 32-34, the receiving channel 212 of the head portion 205 is oriented generally adjacent the interior corner (interface section 207) of the first wrench member 201 where the head portion and the upper distal end of the elongate neck portion 208 intersect. The receiving channel 212 is defined by an interior wall 222 sized and dimensioned for sliding axial receipt of the housing 249 of the illumination device 247 therein. Moreover, as described above and as shown in FIGS. 31 and 32, the communication channel 213 is further formed and dimensioned for sliding axial receipt of the alignment key portion of the illumination device 247 therein, aligning the output portion 248 of the illumination device 247 with the work surface 211 of the first wrench member 201. In turn, rotation of the illumination device 247 within the receiving channel 212 is prevented.

In one specific configuration, the light communication channel 213 tapers radially outward from the receiving channel 212 thereof and toward the end port 214, which terminates at the work area 219. This gradual taper orients the illumination output slightly downward, and facilitates light dispersion so that the light output portion 48 can directly illuminate the work area 219 between the jaws without substantially any obstruction.

In one specific embodiment, the height of the rectangular communication channel, in the transverse cross-sectional dimension, may be in the range of about 0.21" to about 0.23" at the proximal opening at the receiving channel 212, and tapers outward a total in the range of about 50°. That is, the upper taper is in the range of about 0° to about 20° up while the lower taper in the range of about 0° to about 30° down, both relative to a horizontal plane. With respect to the outward side tapers, an outward total in the range of about 30° with one side upper taper in the range of about 0° to about 15° to the right while the opposite side upper taper is in the range of about 0° to about 15° to the left, both relative to a vertical plane.

In accordance with the present invention, the first end cap 250 and second end caps cooperate with the interior wall 222 of the interface section 207 and the housing 249 of the illumination device 47 to sandwich the same therebetween, securely seating the illumination device in the receiving channel (as mentioned above and shown in FIG. 5) Accordingly, the width of the interface section from the one side to the opposite side thereof, together with the illumination device housing 249 dimensions, and the end caps all cooperate for seated interengagement, similar to that mentioned above with the cross-jaw pliers embodiment and the tongue and groove pliers embodiment, when fully assembled Thus, on the first end cap 250 side, the push on/off button 278 of the illumination device 247 will be accessible through the button port. Similarly, on the second end cap side, the battery cover 80 will be accessible via the cover access port 90 (FIGS. 13-15).

Preferably, the interior wall 222 of the receiving channel 212 is threaded, and is configured to threadably engage the threaded exterior facing walls 91, 92 (as representatively shown in FIG. 18) of the respective contact walls 86, 87 of the first and second end caps 50, 51. It will be appreciated, however, that alternative embodiment the end caps can be removably mounted to the corresponding sides of the interface section 207 by machine screws or the like.

In another specific embodiment, the pipe wrench tool assembly 200 may include a secondary light device 347 (FIGS. 36-39), similar to those disclosed above, that is disposed in the coupling portion 217 of the second wrench member 202. Although this secondary light device 347 is disposed below the output of the primary illumination device 247, the illumination output of the secondary light device is oriented to illuminate an area just in front of the work area 219 between the first and second jaw sections 211, 215.

The coupling portion 217 defines a receiving passage 225 laterally extending therethrough from one side to an opposite side thereof. The receiving passage 225 is sized and dimensioned for sliding axial receipt of the housing 349 of the secondary light device 347 therein. The receiving passage 225 is oriented generally perpendicular to the general longitudinal axis of the handle portion 216, and extends generally parallel to the receiving channel 212 of the first wrench member 201. The coupling portion 217 further defines a light communication passage 226 that extends radially from the receiving passage 225, and tapers outwardly and upwardly toward a front of the second wrench member (FIGS. 36-38), and an area in front of the work area 219.

The secondary light device 347 includes an illumination output portion 348 that outputs a direct light beam therefrom and a housing 349 that is formed and dimensioned for removable, axial sliding receipt in the receiving passage 225 of the coupling portion 217. The light output portion 349 is aligned with the communication passage 226 (and the alignment key portion) to output light forwardly and upwardly in front of the work area. In turn, rotation of the illumination device 347 within the receiving passage 225 is prevented.

Moreover, as described above and as shown in FIGS. 37 and 38, the communication passage 226 is angled upwardly, relative to a horizontal plane, and tapers outwardly from a proximal opening into the communication passage 226 toward an end port 227 thereof. This gradual taper facilitates light dispersion so that the light output portion 348 can directly illuminate the aforementioned region without substantially any obstruction. In one specific embodiment, the height of the rectangular communication passage, in the transverse cross-sectional dimension, may be similarly in the range of about 0.21" to about 0.23" at the proximal opening thereof, and tapers outward a total in the range of about 50°. Preferably, however, the lower wall of the communication passage begins at about 30° upward from a horizontal plane, while the upper wall tapers in the range of about 60° to about 80° up, relative to the horizontal plane. With respect to the outward side tapers, an outward total in the range of about 30° with one side upper taper in the range of about 0° to about 15° to the right while the opposite side upper taper is in the range of about 0° to about 15° to the left, both relative to a vertical plane.

Similar to the primary illumination device 247, the light illumination device 347 is secured to the coupling portion 217 by first and second end covers, only first end cover 350 of which is shown. These end covers cooperate with a threaded interior wall 228 of the coupling portion 217 that defines the receiving passage 225, and the illumination device 347 to sandwich the same therebetween, securely seating the illumination device in the receiving passage (as mentioned above and shown in FIG. 5). Accordingly, the width of the coupling portion 217 from the one side to the opposite side thereof, together with the illumination device housing 349 dimensions, and the end covers all cooperate for seated interengagement, similar to that mentioned above with the primary illumination device 247, cross-jaw pliers embodiment and the tongue and groove pliers embodiment, when fully assembled Although only a few embodiments of the present inventions have been described in detail, it should be understood that the present inventions might be embodied in many other specific forms without departing from the spirit or scope of the inventions.

What is claimed is:

1. A pipe wrench assembly comprising:

a first wrench member including a head portion having a first jaw section and an interface section, and an elongate neck portion having a longitudinal axis and integrally intersecting a work surface of said first jaw section at said interface section at generally a right-angle therebetween, said interface section further including a threaded interior wall defining a receiving channel extending laterally therethrough from one side to an opposite side thereof, said interface section further defining a communication channel extending radially from said receiving channel to an end port terminating at the work surface for light communication therebetween;

a second wrench member having a second jaw portion, a handle portion and a coupling portion integral between the second jaw portion and the second handle portion, said coupling portion cooperating with said elongate neck portion to orient the first and second jaw portions are in opposed relationship to one another, defining a work area, and to movably couple said first wrench member to said second member for selective movement in a direction substantially along the longitudinal axis of said neck portion to selectively adjust the size of the work area;

a primary illumination device having an illumination output portion outputting a direct light beam therefrom, and having a housing formed and dimensioned for removable, axial sliding receipt in the receiving channel of said interface section such that said output portion is aligned with said communication channel;

a first end cap disposed in a first opening into said receiving channel, and configured for threaded engagement with said threaded interior wall of said interface section, and a second end cap disposed in an opposite second opening into said receiving channel, and configured for threaded engagement with said threaded interior wall of said interface section, said first end cap and said second end cap threadably cooperating to securely abut and seat said illumination device therebetween.

2. The pipe wrench assembly according to claim 1, wherein said output portion of the illumination device includes an alignment key portion extending radially outward from said exterior surface of the housing, and generally perpendicular to a longitudinal axis of said illumination device, said alignment key being is formed and dimensioned for sliding receipt in a portion of said communication channel.

3. The pipe wrench assembly according to claim 2 wherein said communication channel tapers outwardly from the receiving channel to said end port.

4. The pipe wrench assembly according to claim 3 wherein said illumination device includes a button assembly on one end of said housing, and said first end cap includes a cover disk portion defining a button port formed for receipt of at least a portion of said button assembly to enable operable access thereof when mounted in the first opening of the receiving channel.

5. The pipe wrench assembly according to claim 4, wherein said illumination device includes a battery cover on an opposite end of said housing, and said second end cap includes a cover disk portion defining a battery cover port formed for operable access to said battery cover when mounted the second opening of the receiving channel.

6. The pipe wrench assembly according to claim 5, wherein each said first end cap and said second end cap include respective annular contact walls downwardly depending from an underside of the respective cover disk portion thereof, each respective contact wall having an exterior facing surface configured for threaded engagement with the threaded interior wall of said receiving channel, and each having an interior facing surface defining a respective receiving recess formed and dimensioned for respective seated receipt of the one end and the opposite end the housing when both the first end cap and the second end cap are threadably mounted to threaded interior wall.

7. The pipe wrench assembly according to claim 6, wherein said elongated neck of the first wrench member is threaded, said coupling portion of the second wrench member defines a receiving channel extending from an upper portion thereof to a lower portion thereof proximate to said handle portion, said receiving channel being formed and dimensioned for sliding receipt of the neck portion longitudinally therethrough enabling relative movement of said first work surface toward and away from said second work surface, said second wrench member further including a manually threaded nut device disposed along a bottomside of said coupling portion in threaded engagement with the neck portion of said first wrench member.

8. The pipe wrench assembly according to claim 1, wherein said coupling portion of said second wrench member includes a first side, an opposite second side, and a front wall extending therebetween, said coupling portion further defining a receiving passage extending laterally therethrough from said first side to said second side thereof, said coupling portion further defining a communication aperture extending radially from said receiving passage to an end opening terminating at the front wall surface for light communication therebetween;

a secondary light device having a light output portion outputting a direct light beam therefrom, and having a housing formed and dimensioned for removable, axial sliding receipt in the receiving passage of said coupling portion of the second wrench member such that said output portion is aligned with said communication passage;

a first end cover disposed in a first opening into said receiving passage; and a second end cover disposed in an opposite second opening into said receiving passage, said first end cover and said second end cover cooperating to securely abut and seat said light device therebetween.

9. The pipe wrench assembly according to claim 8, wherein said output portion of the light device includes an alignment key portion extending radially outward from said exterior surface of the housing, and generally perpendicular to a longitudinal axis of said light device, said alignment key being is formed and dimensioned for sliding receipt in a portion of said communication aperture.

10. The pipe wrench assembly according to claim 9 wherein said communication aperture tapers outwardly from the receiving passage to said end opening.

11. The pipe wrench assembly according to claim 10 wherein said light device includes a button assembly on one end of said housing, and said first end cover includes a cover disk portion defining a button port formed for receipt of at least a portion of said button assembly to enable operable access thereof when mounted in the first opening of the receiving passage.

12. The pipe wrench assembly according to claim 11, wherein said light device includes a battery cover on an opposite end of said housing, and said second end cap includes a cover disk portion defining a battery cover port formed for operable access to said battery cover when mounted the second opening of the receiving channel.

13. The pipe wrench assembly according to claim 12, wherein an interior wall defining said receiving passage is threaded, and at each of said first and second end cover being threadably mounted to said interior wall.

14. The pipe wrench assembly according to claim 13, wherein each said first end cover and said second end cover include respective annular contact walls downwardly depending from an underside of the respective cover disk portion thereof, each respective contact wall having an exterior facing surface configured for threaded engagement with the threaded interior wall of said receiving channel, and each having an interior facing surface defining a respective receiving recess formed and dimensioned for respective seated receipt of the one end and the opposite end the housing when both the first end cover and the second end cover are threadably mounted to threaded interior wall.

* * * * *